US007445680B2

(12) United States Patent
Iwama et al.

(10) Patent No.: US 7,445,680 B2
(45) **Date of Patent: *Nov. 4, 2008**

(54) LEAD-FREE STEEL FOR MACHINE STRUCTURAL USE WITH EXCELLENT MACHINABILITY AND LOW STRENGTH ANISOTROPY

(75) Inventors: Naoki Iwama, Tokai (JP); Susumu Owaki, Tokai (JP); Masao Uchiyama, Tokai (JP); Isao Fujii, Tokai (JP); Syoji Nishimon, Tokai (JP); Norimasa Tsunekage, Himeji (JP); Kazuhiro Kobayashi, Himeji (JP); Motohide Mori, Toyota (JP); Kazutaka Ogo, Aichi-gun (JP); Kunio Naito, Aichi-gun (JP)

(73) Assignee: Sanyo Special Steel Co., Ltd., Himeji-shi (JP)

( * ) Notice: Subject to any disclaimer, the term of this patent is extended or adjusted under 35 U.S.C. 154(b) by 494 days.

This patent is subject to a terminal disclaimer.

(21) Appl. No.: 10/912,229

(22) Filed: Aug. 6, 2004

(65) Prior Publication Data

US 2005/0058567 A1 Mar. 17, 2005

Related U.S. Application Data

(63) Continuation of application No. 10/182,714, filed as application No. PCT/JP00/00775 on Feb. 10, 2000, now Pat. No. 7,195,736.

(51) Int. Cl.
*C22C 38/60* (2006.01)

(52) U.S. Cl. ..... 148/320; 148/330; 148/331; 148/333; 420/87

(58) Field of Classification Search ..... 148/320, 148/330, 331, 333
See application file for complete search history.

(56) References Cited

U.S. PATENT DOCUMENTS

| | | | | |
|---|---|---|---|---|
| 3,647,425 | A | 3/1972 | Miyashita et al. | |
| 3,988,174 | A * | 10/1976 | Kawano | 148/602 |
| 4,004,922 | A | 1/1977 | Thivellier et al. | |
| 4,431,445 | A | 2/1984 | Furusawa et al. | |
| 6,596,227 | B2 | 7/2003 | Shindo et al. | |
| 7,195,736 | B1 * | 3/2007 | Iwama et al. | 420/84 |

FOREIGN PATENT DOCUMENTS

| | | |
|---|---|---|
| EP | 0 487 024 | 5/1992 |
| GB | 762801 | 1/1977 |
| JP | 46-30935 | 9/1971 |
| JP | 51-4934 | 2/1976 |
| JP | 51-63312 | 6/1976 |
| JP | 52-7405 | 3/1977 |
| JP | 57-140853 | 8/1982 |
| JP | 57-140854 | 8/1982 |
| JP | 60-059052 | 4/1985 |
| JP | 60-75549 | 3/1989 |
| JP | 1-168848 | 7/1989 |
| JP | 2-47240 | 2/1990 |
| JP | 3-177539 | 8/1991 |
| JP | 3-240931 | 10/1991 |
| JP | 03-285042 | 12/1991 |
| JP | 5-15777 | 3/1993 |
| JP | 07-188847 | 7/1995 |
| JP | 07-188849 | 7/1995 |
| JP | 9-192799 | 7/1997 |
| JP | 9-217147 | 8/1997 |
| JP | 10-176241 | 6/1998 |
| JP | 11-229074 | 8/1999 |
| JP | 11-293382 | 10/1999 |
| JP | 11-350065 | 12/1999 |
| JP | 2000-87179 | 3/2000 |
| JP | 2000-087179 | 3/2000 |
| JP | 2000-256785 | 9/2000 |
| JP | 2000-282169 | 10/2000 |
| JP | 2001-152280 | 6/2001 |
| WO | WO 99/45162 | 9/1999 |

OTHER PUBLICATIONS

Hasndbook of Special Steal, pp. 14-9 to 14-13, Published by Rikogakusha Publishing Co. Ltd. (with partial English translation).

Material for the 101st Special Steel Sectional Meeting of Joint Research Society in ISIJ 1996 (with partial English translation).

"Stahl und Eisen", No. 8 (cover, table of contents, copyright page and pp. 79-89) (with partial English translation) Aug. 1997.

"Current advances in materials and processes", Report of the ISIJ Meeting. vol. 8 No. 1 (cover, table of contents, pp. 55-58 and copyright page) 1995 (with partial English translation).

"Clean Steel" (cover, general table of contents, and "Present and future perspective of production techniques for ultra clean steel"), published by ISIJ, pp. 1-10 (with partial English translation).

Proceedings "4" International Conference on molten slags and fluxes, Published By ISIJ pp. 499-504, Jun. 8, 1992-Jun. 11, 1992.

* cited by examiner

*Primary Examiner*—George Wyszomierski
(74) *Attorney, Agent, or Firm*—Oblon, Spivak, McClelland, Maier & Neustadt, P.C.

(57) ABSTRACT

A lead-free steel for machine structural use with excellent machinability and low strength an isotropy, which does not contain Pb and is equal to or higher than a conventional D Pb-containing free cutting steel in properties, is provided. This steel includes, on the weight basis, C: 0.10 to 0.65%; Si: 0.03 to 1.00%; Mn: 0.30 to 2.50%; S: 0.03 to 0.35%; Cr: 0.1 to 2.0%; Al: less than 0.010%; Ca: 0.0005 to 0.020%; Mg: 0.0003 to 0.020%; 0: less than 20 ppm; and the balance being Fe and inevitable impurities.

16 Claims, 5 Drawing Sheets

LEAD-FREE STEEL FOR MACHINE STRUCTURAL USE WITH EXCELLENT MACHINABILITY AND LOW STRENGTH ANISOTROPY

This is a continuation application of U.S. application Ser. No. 10/182,714, filed Dec. 9, 2002, now allowed, which is a 371 of PCT/JP00/00775, filed Feb. 10, 2000.

TECHNICAL FIELD

The present invention relates to a lead-free steel for machine structural use which exhibits low anisotropy in mechanical properties and excellent machinability in various cutting methods and cutting conditions and which does not contain lead.

BACKGROUND ART

Following recent acceleration and automation in cutting, importance has been given to the machinability of a steel employed for machine structural parts and a demand for so-called free cutting steels having improved machinability has risen. Further, the request for the strength of a steel material is becoming stricter. If the strength of a steel material is increased, the machinability thereof is deteriorated. That is, improvements in contradicting properties, i.e., high strength and machinability, are required for recent structure steels.

At present, steel materials which contain Pb, S and Ca, respectively, are known as ordinary-used free cutting steels. Among these steels, the Pb-containing free cutting steel which contains Pb exhibits excellent properties that it is lower in the deterioration of mechanical properties than a standard steel, it has improved chip disposability (the property capable of discharging chips more smoothly) in ordinary turning, and it is capable of lengthening the life of a tools employed for drilling, tapping, reaming, boring or the like. Furthermore, the Pb-containing free cutting steel facilitates discharging chips at the time of deep drilling to give (hole depth/drill diameter) ≧3 and is excellent in the prevention of the breakage of the tool due to sudden chip clogging.

In addition, various types of Pb composite free cutting steels are under development, which have the above excellent properties by adding elements such as S and Ca other than Pb.

However, the conventional Pb-containing free cutting steels has the following disadvantages.

Namely, although Pb is a quite effective element for the improvement of machinability of steels, it is an environmentally hazardous material. Due to this, because of a recent increase in interest in the environmental issues, it is desired to develop a steel material without Pb and comparable to the Pb-containing free cutting steel.

On the other hand, although there are conventionally known other free cutting steels without Pb, they cannot be replaced with the Pb-containing free cutting steel. It's because these steels have the following disadvantages.

For example, an S-containing free cutting steel which contains S has an improvement effect of lengthening the life of a tool for a relatively wide range of cutting; however, it is inferior to the Pb-containing free cutting steel in chip disposability. In addition, if a steel contains S, MnS which exists as an inclusion is extended during hot rolling or hot forging. Due to this, such a steel has a disadvantage in strength anisotropy, i.e. the mechanical properties of such a steel including impact strength are deteriorated as the direction is closer from an rolling direction to a right angle direction. Accordingly, it is necessary to suppress the S content of a steel material intended to be employed as a component which is considered to be given much importance to impact strength, which in turn provides insufficient machinability.

Further, a Ca-deoxidized free cutting steel in which the melting point of an oxide-based inclusion in the steel is lowered by Ca deoxidization, hardly influences the strength property of the steel material and exhibits an excellent effect of lengthening the life of a carbide tool in a high velocity cutting region. However, the Ca-deoxidized free cutting steel has little effect in machinability improvement other than the effect of lengthening the life of the carbide tool. Normally, therefore, the Ca-deoxidized free cutting steel is employed in combination with S or Pb so as to obtain all-round machinability.

There is a steel material described in Japanese Examined Patent Publication No. 5-15777 which illustrates an example in which the disadvantage of the S-containing free cutting steel, i.e. strength an isotropy, is improved by adding Ca and uniformly dispersing and distributing inclusions in the steel and, at the same time, the machinability of the steel is improved, opposed to the conventional Ca-deoxidized free cutting steels. In this case, the steel material is free from the disadvantage like the Ca-deoxidized free cutting steel has; however, it is required to add a large quantity of S to the steel material so as to ensure adequate machinability. In the above case, a sufficient quantity of Ca should be added to the steel material to control the form of the sulfide. However, in this case, Ca yield is lowered, which make it quite difficult to realize the quantity-production of steels.

Additionally, there is known steel materials described in Japanese Examined Patent Publication No. 52-7405 as an example of steels intended to attain the same effect as that of adding Ca described above. These are free cutting steels which contain one or two of Group I elements of Mg and Ba and one or more of Group II elements of S, Se and Te. Since O is actively added to these steel materials in a range of 0.004 to 0.012%, they might be low in fatigue strength. Besides, oxides in the steels increase by the active addition of O, thereby possibly deteriorating machinability such as drilling machinability.

Moreover, Japanese Examined Patent Publication No. 51-4934 discloses a free cutting steel which contains one or two of Group I elements of Mg and Ba and one or more of Group II elements of S, Se and Te, as well as a free cutting steel which selectively contains Ca. However, O is actively added to these steels in a range of 0.002 to 0.01%. Therefore, they might be low in fatigue strength. Besides, oxides in the steels increase by the active addition of O, thereby possibly deteriorating machinability such as drilling machinability.

Japanese Patent Publication No. 51-63312 discloses a free cutting steel which contains S, Mg and one or more elements of Ca, Ba, Sr, Se and Te. However, 51-63312 fails to concretely show the composition of the steel and insufficiently discloses the technique. In addition, since this steel is based on the assumption of Al deoxidization, there is fear that an Al content thereof exceeds 0.02%, no restriction is given to an O content thereof and fatigue strength is lowered. There is also fear that the quantity of oxides in the steel increase by the active addition of O, and the machinability such as drilling machinability is, therefore, deteriorated.

The present invention has been achieved in view of the above-stated conventional disadvantages and has an object to provide a lead-free steel for machine structural use, which does not contain Pb and is equal to or higher than the conventional Pb-containing free cutting steels in properties, excellent in machinability and low in strength anisotropy.

DISCLOSURE OF THE INVENTION

The invention of a first objective is a lead-free steel for machine structural use with excellent machinability and low strength anisotropy, comprising, on the weight basis, C: 0.10 to 0.65%; Si: 0.03 to 1.00%; Mn: 0.30 to 2.50%; S: 0.03 to 0.35%; Cr: 0.1 to 2.0%; Al: less than 0.010%; Ca: 0.0005 to 0.020%; Mg: 0.0003 to 0.020%; O: less than 20 ppm; and the balance being Fe and inevitable impurities.

The most notable advantages of the present invention are that an Al content and an O content are decreased to the above specific ranges, respectively, an S content is made higher than an ordinary level, Mg and Ca are added, and the addition of Pb is completely eliminated.

Steels for machine structural use are roughly classified to three types of a heat-treated steel, a non-heat treated steel and a case hardening steel which are employed differently according to purposes and the like. Due to this, in the lead-free steel for machine structural use of the present invention, these three types of steels are different slightly in preferred composition ranges.

Now, the reason for restricting the composition ranges will be described below while referring to preferred ranges for the three types of steels.

C: 0.10 to 0.65%

C is an essential element for securing strength as the steel for machine structural use and not less than 0.10% of C is added. However, too much C causes the increase of hardening and deteriorates toughness and machinability. Therefore, the upper limit is set at 0.65%.

The C content of the heat-treated steel is, in particular, preferably 0.28 to 0.55%, more preferably 0.32 to 0.48%.

The C content of the non-heat treated steel is preferably 0.10 to 0.55%, more preferably 0.35 to 0.50%.

The C content of the case hardening steel is preferably 0.10 to 0.30%, more preferably 0.12 to 0.28%.

Si: 0.03 to 1.00%

Since Si is an essential element as a deoxidizing agent in the manufacturing of a steel, the lower limit is set at 0.03%. However, too much Si deteriorates ductility; besides, it also deteriorates machinability by generating $SiO_2$ which forms inclusion of high hardness in the steel. Therefore the upper limit thereof is set at 1.00%.

The Si content of any of the above three types of steels is preferably 0.10 to 0.50%, more preferably 0.15 to 0.35%.

Mn: 0.30 to 2.50%

Generally, Mn is an important element to secure the strength, toughness, ductility in hot rolling and harden ability, and Mn is an essential element to generate a sulfide-based inclusion according to the present invention. Therefore, not less than 0.30% of Mn is added. However, too much Mn causes the increase of hardness and deteriorates machinability. Therefore, the upper limit is set at 2.50%.

The Mn content of any of the above three types of steel is preferably 0.40 to 2.00%, more preferably 0.60 to 1.50%.

S: 0.03 to 0.35%

S is an element for generating a sulfide-based inclusion which can improve machinability. To obtain a machinability improvement effect, it is necessary to add at least not less than 0.03% of S. As S content increases, machinability improves. However, too much S makes it difficult to control the form of the sulfide by Ca and Mg and deteriorates impact-resistance anisotropy. Therefore, the upper limit is set at 0.35%.

The S content of any of the above three types of steel is preferably 0.04 to 0.30%, more preferably 0.08 to 0.20%.

Cr: 0.1 to 2.0%

Cr is added to improve the hardenability and toughness of the steel. To obtain the effects, not less than 0.1% of Cr is necessary. On the other hand, if a large quantity of Cr is added, the hardness of a work material increases. It is, therefore, necessary to set a Cr content at not more than 2.0% so as to secure machinability.

The Cr content of any of the above three types of steels is preferably 0.10 to 1.50%, more preferably 0.15 to 1.20%.

Al: less than 0.010%

If an Al content is not less than 0.010%, an inclusion consisting of $Al_2O_3$ with a high hardness is generated, which causes the deterioration of machinability and that of fatigue strength.

The preferred range for the Al content hardly differs among the above three types of steels.

Ca: 0.0005 to 0.020%

Ca as well as Mn and Mg is an element for generating a sulfide. In addition, Ca generates a mixed oxide of Al and Si and contributes to the improvement effects of a machinability and an anisotropy of mechanical property by the control of the conformation of a sulfide. To obtain the effects, it is necessary to add at least not less than 0.0005% of Ca. On the other, Ca yield is very low in the manufacturing of the steel. The effects are saturated if Ca is included more than required. Therefore the upper limit thereof is set at 0.020%.

The Ca content of any of the above three types of steels is preferably 0.0005 to 0.0060%, more preferably 0.0005 to 0.0040%.

Mg: 0.0003 to 0.020%

Mg exhibits the same effects as those of Ca. If combined with Ca, Mg contributes to a great improvement effects of a machinability and an anisotropy of mechanical property. To obtain the effects, it is necessary to add at least not less than 0.0003% of Mg. The effects are saturated in vain if Mg is included more than required. Therefore the upper limit thereof is set at 0.020%.

The Mg content of any of the above three types of steels is preferably 0.0003 to 0.0060%, more preferably 0.0005 to 0.0040%.

O: less than 20 ppm

It is desirable that O is decreased as much as possible so as to suppress the generation of an oxide-based hard inclusion harmful to machinability. If not less than 20 ppm of O is included, the quantity of generated oxide-based hard inclusion increases, which deteriorates machinability and fatigue strength. It is, therefore, necessary to set the quantity of O at less than 20 ppm.

The preferred range for O hardly differs among the three types of steels.

As can be understood, according to the present invention, it is possible to restrict the form of an oxide by giving such limitations to the Al content and O content, respectively, and it is possible to minimize the deterioration of impact properties, particularly impact-resistance anisotropy (strength anisotropy) and to improve the machinability of the steel comparably to that of a Pb-containing free cutting steel by setting the S content higher than an ordinary level and simultaneously including Ca and Mg in the steel. These strength anisotropy and machinability improvement effects are greater than a case where only one of Ca or Mg is contained in the steel material.

Further, according to the present invention, it is possible to obtain a fatigue strength improvement effect and the like besides the machinability improvement effect by giving the above-stated restrictions to the Al content and the O content, respectively.

Next, the invention of a second objective is a lead-free steel for machine structural use with excellent machinability and low strength anisotropy, comprising, on the weight basis, C: 0.10 to 0.65%; Si: 0.03 to 1.00%; Mn: 0.30 to 2.50%; S: 0.03 to 0.35%; Cr: 0.1 to 2.0%; Al: less than 0.005%; Ca: 0.0005 to 0.020%; Mg: 0.0003 to 0.020%; O: less than 20 ppm; and the balance being Fe and inevitable impurities.

The most notable advantage of the present invention is that the Al content is further decreased from that of the lead-free steel for machine structural use according to claim 1, to less than 0.005%.

The continuous casting property of this lead-free steel for machine structural use, which influences practical manufacturing, can be greatly improved by setting the Al content at less than 0.005%.

That is, the Al content of not less than 0.005% accelerates the generation of CaS in large quantities in the molten steel, whereby CaS is deposited on continuous casting nozzles and the nozzles tend to be clogged. By restricting the Al content to less than 0.005%, this disadvantage can be surely overcome.

Further, as shown in the invention of a third objective, it is preferable that the lead-free steel for machine structural use further comprises one or more elements selected from a group of, on the weight basis, Mo: 0.05 to 1.00%, Ni: 0.1 to 3.5%, V: 0.01 to 0.50%, Nb: 0.01 to 0.10%, Ti: 0.01 to 0.10% and B: 0.0005 to 0.0100%.

The reason for restricting the preferred. composition ranges will be described hereinafter.

Mo: 0.05 to 1.00%, and Ni: 0.1 to 3.5%

Mo and Ni are elements which can improve the hardenability and toughness of the steel and are added if necessary. To obtain these effects, it is preferable to add not less than 0.05% of Mo and not less than 0.1% of Ni. Too much Mo and Ni cause the increase of the hardness of the work material. Therefore, to secure machinability, it is preferable that the Mo content is set at not more than 1.00% and the Ni content is set at not more than 3.5%.

The Mo content of any of the above three types of steels is preferably 0.10 to 0.40%, more preferably 0.15 to 0.30%.

Further, the Ni content of any of the above three types of steels is preferably 0.40 to 3.00%, more preferably 0.40 to 2.00%.

V: 0.01 to 0.50%

Since V is an element which has a strong precipitation strengthening effect, it is added if hardening and tempering treatments are omitted. To obtain this effect, it is preferable to add not less than 0.01% of V. If the V content is more than 0.50%, the effect is saturated. It is, therefore, preferable to set the upper limit at 0.50%.

The V content of the non-heat treated steel is preferably 0.05 to 0.35%, more preferably 0.05 to 0.30%.

Nb: 0.01 to 0.10%, and Ti: 0.01 to 0.10%

Nb and Ti have effects of generating carbonitrides and making crystal grains finer by the pinning effect, respectively, and are added if necessary. To obtain these effects, it is necessary to add not less than 0.01% of Nb and not less than 0.01% of Ti. However, if more than 0.10% of Nb and more than 0.10% of Ti are included in the steel, these effects are saturated. Therefore, the respective upper limits are preferably 0.10%. The range is more preferably 0.01 to 0.08%, most preferably 0.01 to 0.06%

B: 0.0005 to 0.0100%

Even a low B content has effects of improving the hardenability and mechanical properties of the steel, and B is added if necessary. To obtain the effects, it is necessary to add not less than 0.0005% of B. If more than 0.0100% of B is contained, the effects are saturated. The upper limit is, therefore, preferably 0.0100%. The range is more preferably 0.0005 to 0.0060% most preferably 0.0005 to 0.0040%.

Furthermore, as shown in the invention of a fourth objective, it is preferable that the lead-free steel for machine structural use further comprises one or two elements selected from a group of, on the weight basis, Bi: 0.01 to 0.30% and REM: 0.001 to 0.10%.

The reason for restricting the preferred composition ranges will be described hereinafter.

Bi: 0.01 to 0.30%

Since Bi is effective to improve the chip disposability and drilling property of the steel with hardly deteriorating an anisotropy of mechanical property, it is added if these properties are necessary. To obtain the effect, it is necessary to add not less than 0.01% of Bi. However, if more than 0.30% of Bi is contained, the effect is saturated and cost increases. Therefore, the upper limit is preferably 0.30%. The range is more preferably 0.01 to 0.10%, most preferably 0.01 to 0.08%.

REM: 0.001 to 0.10%

Since an REM (rare-earth element) has a great effect of controlling the form of a sulfide, it is employed to accelerate the effects of Mg and Ca. It is noted that the REM mainly consists of mixed alloys of Ce, La, Nd, Pr and Sm. To obtain this effect, it is necessary to add not less than 0.001% of REM. However, if more than 0.10% of REM is contained, the effect is saturated and cost increases. Therefore, the upper limit is preferably 0.10%. The range is more preferably 0.001 to 0.006%, most preferably 0.001 to 0.004%.

Moreover, as shown in the invention of a fifth objective, it is preferable that the lead-free steel for machine structural use comprises one or two selected from a group of (Ca, Mg)S and (Ca, Mg, Mn)S as a sulfide-based inclusion. There are various sulfides combining S with Ca, Mg and Mn. Among them, as described above, by particularly including at least one of a mixed sulfide (Ca, Mg)S consisting of Ca, Mg and S or a mixed sulfide (Ca, Mg, Mn)S consisting of Ca, Mg, Mn and S, it is possible to greatly improve the carbide tool wear property.

BEST MODES FOR CARRYING OUT THE INVENTION

To evaluate the excellent properties of a lead-free steel for machine structural use according to the present invention, various tests have been conducted for each of three types of steels, i.e. heat-treated steels, non-heat treated steels and case hardening steels.

The results of these tests will be shown below as embodiments.

First Embodiment

In this embodiment, as shown in Tables 1 and 3, a steel A according to the present invention and conventional steels B and C, which are all heat-treated steels, are prepared and compared with one another.

The conventional steel B is a Pb-containing free cutting steel which contains 0.1% of Pb. This conventional steel B is out of the scope of the present invention in terms of an S content and an O content.

Further, the conventional steel C is a steel to which Ca and Mg are not added.

Each steel material is molten in a vacuum melting furnace with the capacity of 100 kg, forged and extended to ϕ60 mm at 1200° C., and a part thereof is further forged and extended to a rectangular steel material of 40×70 mm. Thereafter, each steel is subjected to a heat treatment including hardening at 880° C. and then tempering at 580° C.

Using the steel material of ϕ60 mm, machinability tests, a tensile test and an impact test in a forging and extending direction (which direction will be referred to as L-direction hereinafter) are conducted. In addition, using the rectangular steel products of 40×70 mm, impact tests in a direction which is perpendicular to the forging and extending direction (which direction will be referred to as T-direction hereinafter) are conducted.

Machinability test methods and cutting conditions are shown in Table 2. A JIS No. 4 specimen and a JIS No. 3 specimen are employed as a tensile test specimen and an impact test specimen, respectively.

Considering that the object of the present invention is to develop a steel which replaces a Pb-containing free cutting steel, the machinability test evaluation items are evaluated with an emphasis on chip disposability and drilling machinability which are advantages of the Pb-containing free cutting steel.

Figure 1:
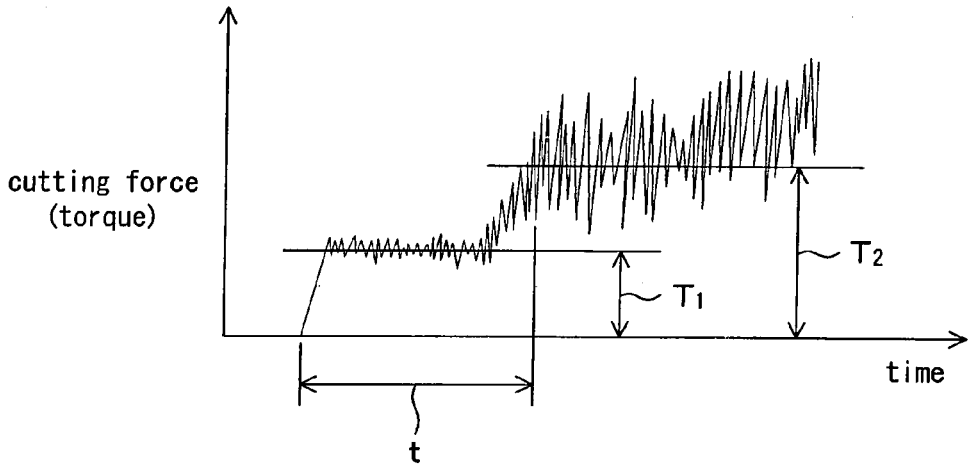
FIG. 1 is an explanatory view showing an evaluation method for deep-drilling properties in the first embodiment.

Further, as shown in FIG. 1, in a deep drilling test which is one of machinability tests, a cutting force (torque $T_2$) is measured from the start of drilling. While assuming drilling time t required until the torque $T_2$ becomes twice as large as a stable drilling torque $T_1$ as "stable drilling time", "stable drilling depth (mm)" which is defined as "stable drilling time (sec)"×"feed (mm/sec)" is calculated and evaluated.

The test result and the like are shown in Table 3.

As seen in Table 3, the steel A according to the present invention, as the heat-treated steel, exhibits superior properties to those of the conventional steels B and C for all the evaluation items. As for the drill life, in particular, the steel A is far superior to the conventional Pb-containing free cutting steels.

TABLE 1

First Embodiment–Third Embodiment

| Embodiment | | | Chemical Component(% by weight; Ca, Mg, O: ppm by weight) | | | | | | | | | | | | | | | | |
|---|---|---|---|---|---|---|---|---|---|---|---|---|---|---|---|---|---|---|---|
| No. | steel type | | C | Si | Mn | P | S | Cu | Ni | Cr | Mo | Al | Nb | V | Pb | Bi | Ca | Mg | O |
| 1 heat-treated steel | steel of the present invention | A | 0.39 | 0.24 | 0.99 | 0.014 | 0.096 | 0.13 | 0.15 | 1.14 | — | 0.007 | — | — | — | — | 20 | 27 | 11 |
| | conventional steel | B | 0.38 | 0.22 | 0.81 | 0.013 | 0.015 | 0.12 | 0.08 | 1.13 | — | 0.003 | — | — | 0.10 | — | — | — | 21 |
| | | C | 0.40 | 0.25 | 0.90 | 0.013 | 0.062 | 0.12 | 0.08 | 1.09 | — | 0.006 | — | — | — | — | — | — | 15 |
| 2 non-heat treated steel | steel of the present invention | D | 0.40 | 0.26 | 1.19 | 0.023 | 0.175 | 0.10 | 0.04 | 0.18 | — | 0.002 | — | 0.12 | — | — | 20 | 14 | 11 |
| | conventional steel | E | 0.39 | 0.25 | 0.86 | 0.019 | 0.015 | 0.11 | 0.05 | 0.20 | — | 0.029 | — | 0.11 | 0.17 | — | — | — | 19 |
| | | F | 0.40 | 0.25 | 0.90 | 0.018 | 0.060 | 0.09 | 0.04 | 0.18 | — | 0.014 | — | 0.11 | 0.18 | — | 22 | — | 16 |
| | | G | 0.40 | 0.25 | 0.99 | 0.018 | 0.098 | 0.10 | 0.04 | 0.19 | — | 0.014 | — | 0.11 | — | — | — | — | 18 |
| 3 case hardening steel | steel of the present invention | H | 0.21 | 0.23 | 0.98 | 0.018 | 0.090 | 0.13 | 0.70 | 0.49 | 0.20 | 0.003 | 0.050 | — | — | — | 30 | 21 | 17 |
| | | I | 0.20 | 0.24 | 0.97 | 0.019 | 0.092 | 0.12 | 0.69 | 0.50 | 0.20 | 0.003 | 0.040 | — | — | 0.040 | 24 | 11 | 16 |
| | conventional steel | J | 0.20 | 0.24 | 0.76 | 0.019 | 0.020 | 0.14 | 0.71 | 0.49 | 0.19 | 0.025 | 0.050 | — | 0.11 | — | — | — | 16 |
| | | K | 0.21 | 0.25 | 0.86 | 0.017 | 0.054 | 0.12 | 0.70 | 0.50 | 0.20 | 0.020 | 0.050 | — | — | — | — | — | 19 |

TABLE 2

| | test item | | | |
|---|---|---|---|---|
| | carbide tool loss by wear | chip disposability | deep drilling property | drill life |
| tool | P20 | P20 | SKH51(ϕ 6 mm) | SKH51(ϕ 5 mm) |
| cutting speed | 150 m/min | 150 m/min | 19 m/min | 27 m/min |
| feed | 0.2 mm/rev | 0.10, 0.15, 0.20 mm/rev | 0.1 mm/rev | 0.2 mm/rev |
| cutting depth | 1.5 mm | 1.5 mm | — | drilling depth: 15 mm |
| cutting oil | dry type | dry type | dry type | dry type |
| evaluation criterion | flank wear after cutting for 5 minutes | chip disposability index (number of chips/ weight of chips) | stable drilling depth (FIG. 1) | drilling number until damage by melting and fracture |

TABLE 3

First Embodiment–Third Embodiment

| Embodiment No. | steel type | | test result: carbide tool loss by wear (mm) | chip disposability index | deep drilling property (mm) | drill life (drilling number) | cutting test specimen hardness (Hv) | mechanical test specimen hardness (Hv) | tensile strength (Mpa) | impact-resistance anisotropy (T-direction/ L-direction) |
|---|---|---|---|---|---|---|---|---|---|---|
| 1 heat-treated steel | steel of the present invention | A | 0.12 | 13 | 63 | 622 | 295 | 295 | 957 | 0.30 |
| | conventional steel | B | 0.17 | 13 | 60 | 587 | 293 | 293 | 949 | 0.32 |
| | | C | 0.13 | 8 | 35 | 294 | 292 | 292 | 951 | 0.18 |
| 2 non-heat treated steel | steel of the present invention | D | 0.07 | 32 | 94 | 1149 | 244 | 244 | 791 | 0.35 |
| | conventional steel | E | 0.14 | 21 | 69 | 688 | 244 | 244 | 789 | 0.52 |
| | | F | 0.12 | 32 | 94 | 928 | 240 | 240 | 780 | 0.42 |
| | | G | 0.12 | 26 | 47 | 933 | 241 | 241 | 780 | 0.27 |
| 3 case hardening steel | steel of the present invention | H | 0.06 | 22 | 73 | 845 | 193 | 429 | 1294 | 0.48 |
| | | I | 0.06 | 39 | 94 | 996 | 192 | 430 | 1302 | 0.44 |
| | conventional steel | J | 0.09 | 21 | 73 | 730 | 188 | 426 | 1265 | 0.62 |
| | | K | 0.07 | 6 | 29 | 341 | 192 | 430 | 1297 | 0.23 |

Second Embodiment

In this embodiment, as shown in Tables 1 and 3 already described above, a steel D according to the present invention and conventional steels E to G, all of which are non-heat treated steels, are prepared and compared with one another.

The conventional steel E is a Pb-containing free cutting steel which contains 0.17% of Pb. The conventional steel F is a Pb-containing free cutting steel to which Pb and Ca are added, namely which contains 0.18% of Pb and 22 ppm of Ca. The conventional steel G does not contain Ca and Mg. The Al content of each of the conventional steels E to G exceeds 0.010%.

Respective steel materials are molten in a vacuum melting furnace with the capacity of 30 kg, forged and extended to ϕ40 mm at 1200° C., and a part thereof is further forged and extended to a rectangular steel material of 40×70 mm. Thereafter, each of the steels is held for 30 minutes at 1200° C., and then an air-cooling heat treatment is conducted thereto.

Using the ϕ40 mm steel materials, machinability tests, a tensile test and an L-direction impact test are conducted. Using the 40×70 mm rectangular steel materials, a T-direction impact test is conducted.

Test methods, cutting conditions, tensile test specimens and impact test specimens are the same as those in the first embodiment.

The test result and the like are shown in Table 3.

As seen in Table 3, the steel D according to the present invention, as the non-heat treated steel, exhibits superior properties to those of the conventional steels E to G in all the evaluation items. The steel D particularly exhibits far superior performances in carbide tool loss by wear and drill life to those of the conventional Pb-containing free cutting steels.

The reason that the drill life, which is an advantage of the Pb-containing free cutting steel, of the steel D is considerably lengthened compared with that of the conventional steel F which is a lead composite free cutting steel which is excellent in machinability does lie in the fact that the Al content and the O content are simultaneously reduced, the D quantity of oxides and the forms thereof are controlled so as to elevate an S content level and add both of Mg and Ca to the steel, compared with the conventional steels. This improvement cannot be obtained until these processes are performed.

Third Embodiment

In this embodiment, as shown in Tables 1 and 3 already described above, steels H and I according to the present invention and conventional steels J and K, all of which are case hardening steels, are prepared and compared with one another.

The greatest difference between the steels H and I according to the present invention is that Bi is added to the steel H.

The conventional steel J is a free cutting steel to which S and Pb are added in large quantities. The Al content of each of the conventional steels J and K exceeds 0.010%.

Each steel material is molten in a vacuum melting furnace with the capacity of 100 kg, forged and extended to ϕ60 mm at 1200° C., and a part thereof is further forged and extended to la rectangular steel material of 40×70 mm. Thereafter, each steel material is subjected to a normalizing heat treatment for 60 minutes at 900° C.

Using the ϕ60 mm steel materials, machinability tests are conducted. The specimens for tensile test and L-direction impact test are cut out of above ϕ60 mm steel materials and the specimens for T-direction impact test are cut out of the above 40×70 mm rectangular steel materials. After these specimens are hardened at 880° C. and tempered at 180° C., they are finished and then subjected to mechanical tests.

Test methods and the like are the same as those in the first embodiment.

A test result and the like are shown in Table 3.

As seen in Table 3, the steels H and I according to the present invention, as the case hardening steels, exhibit superior properties at least in machinability to those of the conventional steels J and K. In addition, the steels H and I maintain almost the same mechanical properties as those of the conventional steels.

The drill life of the steel H according to the present invention to which Bi is added is, in particular, lengthened surprisingly. This improvement is derived from the fact that the deformation of inclusions are accelerated by the low melting behavior of Bi and the mixed sulfide has an effect of suppressing the progress of the tool wear.

Fourth Embodiment

In this embodiment, a steel L according to the present invention, conventional steels M and N and a comparison steel O, which are non-heat treated steel, are prepared and compared with one another in fatigue properties.

The conventional steel M is a free cutting steel which contains Pb, and the conventional steel N is a Pb composite free cutting steel which contains Ca in addition to Pb.

The comparison steel O is a steel obtained by increasing an O content to more than 20 ppm in the steel according to the present invention.

Each steel material is molten in a vacuum melting furnace with the capacity of 30 kg, forged and extended to ϕ60 mm at 1200° C., held at 1200° C. for 30 minutes and then subjected to an air-cooling heat treatment.

Specimens are cut out from the ϕ60 mm steel materials respectively, and tensile tests and Ono-type rotating and bending fatigue tests are conducted.

A test result is shown in Table 5.

As seen in Table 5, the steel L according to the present invention exhibits tensile strength which has little difference from that of the conventional steel M (lead-containing free cutting steel) and that of the conventional steel N (lead composite free cutting steel) and exhibits a fatigue limit and an endurance ratio which are equal to or higher than those of the conventional steels M and N. In addition, the comparison steel O which is higher in oxygen content than the steel L according to the present invention, is inferior in fatigue properties. It is considered that this is due to the increase of the quantity and magnitude of an oxide inclusion.

TABLE 4

| Fourth Embodiment (non-heat treated steel) | | | | | | | | | | | | | | | |
|---|---|---|---|---|---|---|---|---|---|---|---|---|---|---|---|
| | | Chemical Component (% by weight; Ca, Mg, O: ppm by weight) | | | | | | | | | | | | | |
| steel type | | C | Si | Mn | P | S | Cu | Ni | Cr | Al | V | Pb | Ca | Mg | O |
| steel of the present invention | L | 0.41 | 0.23 | 1.19 | 0.016 | 0.177 | 0.10 | 0.07 | 0.21 | 0.002 | 0.12 | — | 15 | 20 | 14 |
| conventional steel | M | 0.43 | 0.25 | 0.86 | 0.019 | 0.015 | 0.11 | 0.06 | 0.19 | 0.029 | 0.11 | 0.15 | — | — | 14 |
| | N | 0.43 | 0.23 | 0.87 | 0.018 | 0.060 | 0.16 | 0.07 | 0.20 | 0.014 | 0.12 | 0.19 | 24 | — | 17 |
| comparison steel | O | 0.41 | 0.22 | 1.20 | 0.015 | 0.174 | 0.10 | 0.07 | 0.20 | 0.001 | 0.12 | — | 8 | 7 | 31 |

TABLE 5

| Fourth Embodiment (non-heat treated steel) | | | | | |
|---|---|---|---|---|---|
| | | fatigue property | | | |
| steel type | | tensile strength (Mpa) | fatigue limit (Mpa) | endurance ratio | hardness (Hv) |
| steel of the present invention | L | 759 | 343 | 0.452 | 239 |
| conventional steel | M | 762 | 343 | 0.450 | 242 |
| | N | 765 | 343 | 0.448 | 240 |
| comparison steel | O | 761 | 299 | 0.393 | 241 |

Fifth Embodiment

In this embodiment, heat-treated steels and non-heat treated steels are evaluated for continuous casting properties. In this evaluation, as shown in Table 6, steels P to S according to the present invention and comparison steels T to W are prepared. The comparison steels T to W are obtained by increasing the Al contents to not less than 0.05%, respectively, in the steels P to S according to the present invention.

A continuous casting test is conducted using a bloom continuous casting machine of the rating type of 370 mm×530 mm after melting the steels in an electric furnace)-RH (vacuum degassing machine). It is then tested whether or not molten metals of 130 tons are cast by the continuous casting machine.

A test result is shown in Table 7.

As seen in Table 7, all of the 130-ton molten metals are, without choking the nozzles of the casting machine, cast from the respective steels P to S according to the present invention in which Al contents thereof are suppressed to be as low as less than 0.005%.

As for the comparison steels T to W each having an Al content of not less than 0.005%, nozzle choking occurs and the entire 130-ton molten metal cannot be continuously cast.

TABLE 6

Fifth Embodiment

| steel type | | | Chemical Component (% by weight; Ca, Mg, O: ppm by weight) | | | | | | | | | | | | | | |
|---|---|---|---|---|---|---|---|---|---|---|---|---|---|---|---|---|---|
| | | | C | Si | Mn | P | S | Cu | Ni | Cr | Mo | Al | V | Ca | Mg | O | N |
| steel of the present invention | non-heat treated steel | P | 0.39 | 0.22 | 1.20 | 0.019 | 0.174 | 0.19 | 0.10 | 0.19 | 0.03 | 0.002 | 0.12 | 10 | 9 | 11 | 127 |
| | | Q | 0.42 | 0.23 | 1.20 | 0.020 | 0.169 | 0.09 | 0.07 | 0.20 | 0.02 | 0.002 | 0.12 | 12 | 10 | 14 | 122 |
| | heat-treated steel | R | 0.39 | 0.24 | 0.99 | 0.014 | 0.096 | 0.10 | 0.15 | 1.14 | 0.00 | 0.003 | — | 20 | 27 | 9 | 85 |
| | | S | 0.41 | 0.23 | 1.03 | 0.020 | 0.101 | 0.13 | 0.16 | 1.09 | 0.02 | 0.002 | — | 19 | 19 | 10 | 74 |
| comparison steel | non-heat treated steel | T | 0.42 | 0.29 | 1.18 | 0.016 | 0.175 | 0.10 | 0.05 | 0.20 | 0.03 | 0.008 | 0.12 | 9 | 23 | 16 | 118 |
| | | U | 0.40 | 0.43 | 1.25 | 0.017 | 0.152 | 0.15 | 0.08 | 0.20 | 0.05 | 0.008 | 0.12 | 8 | 10 | 13 | 124 |
| | heat-treated steel | V | 0.40 | 0.25 | 1.00 | 0.012 | 0.103 | 0.07 | 0.16 | 1.10 | 0.01 | 0.007 | — | 18 | 25 | 11 | 87 |
| | | W | 0.40 | 0.26 | 0.98 | 0.018 | 0.100 | 0.13 | 0.16 | 1.12 | 0.03 | 0.009 | — | 20 | 21 | 11 | 82 |

TABLE 7

Fifth Embodiment

| steel type | | | continuous casting test result | evaluation |
|---|---|---|---|---|
| steel of the present invention | heat-treated steel | P | all of 130-ton molten metals were cast, without choking the nozzles of the casting machine. | ○ |
| | | Q | all of 130-ton molten metals were cast, without choking the nozzles of the casting machine. | ○ |
| | non-heat treated steel | R | all of 130-ton molten metals were cast, without choking the nozzles of the casting machine. | ○ |
| | | S | all of 130-ton molten metals were cast, without choking the nozzles of the casting machine. | ○ |
| comparison steel | heat-treated steel | T | nozzle choking occurred at the time of casting 80-ton molten metals, and then the casting was stopped. | X |
| | | U | nozzle choking occurred at the time of casting 100-ton molten metals, and then the casting was stopped. | X |
| | non-heat treated steel | V | nozzle choking occurred at the time of casting 50-ton molten metals, and then the casting was stopped. | X |
| | | W | nozzle choking occurred at the time of casting 60-ton molten metals, and then the casting was stopped. | X |

Sixth Embodiment

In this embodiment, steel X which is a non-heat treated steel according to the present invention shown in Table 8 is prepared and inclusions in the steel are observed.

The steel X according to the present invention is molten in a vacuum melting furnace with the capacity of 30 kg and forged and extended to ϕ40 mm at 1200° C. Thereafter, the steel is held at 1200° C. for 30 minutes and then subjected to an air-cooling heat treatment.

Figure 2:
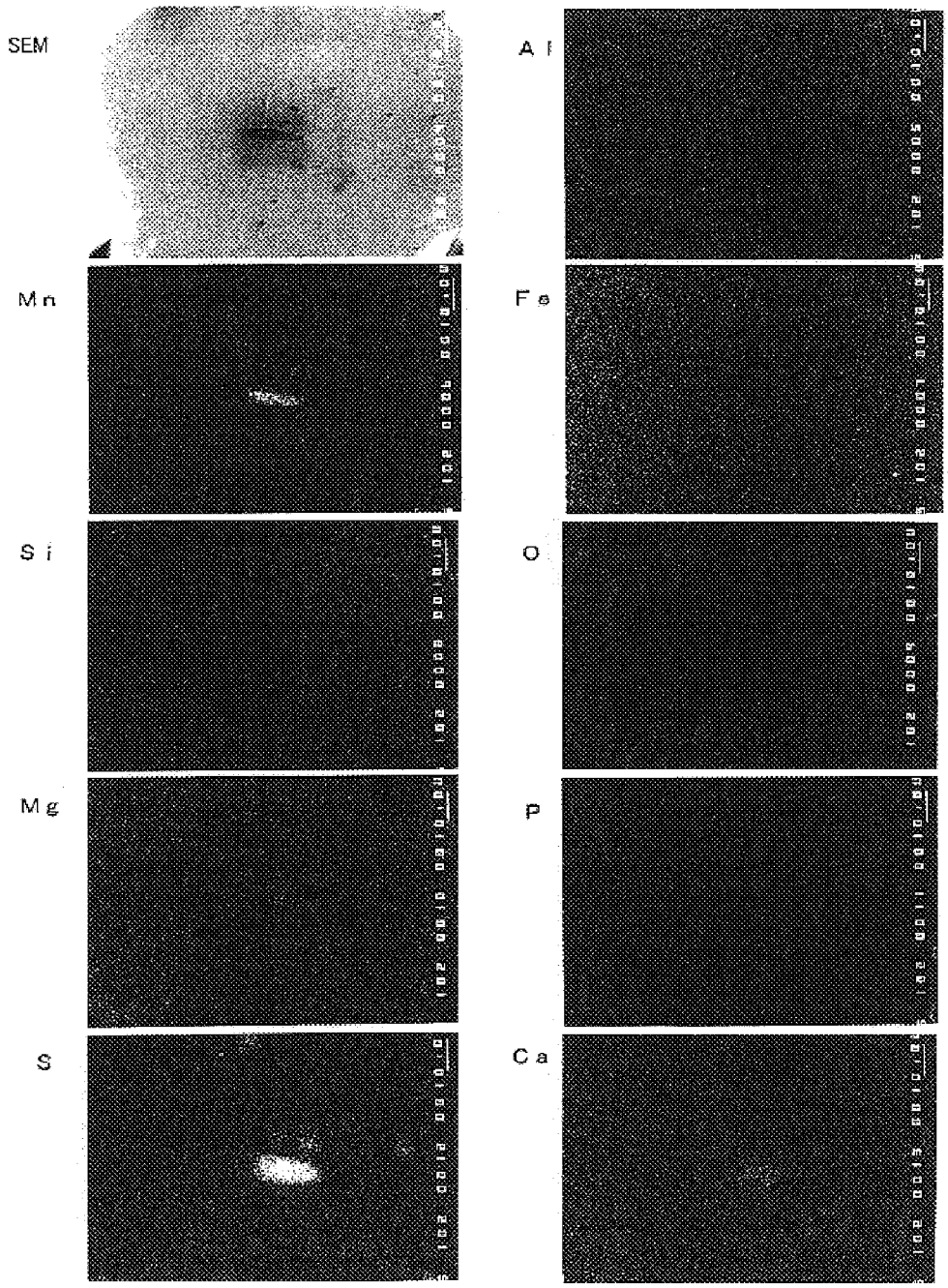
FIG. 2 is a drawing-replacing photograph which shows images of respective elements in a steel X according to the present invention in the sixth embodiment.

The result of inclusion observation is shown in FIG. 2. FIG. 2 is a drawing-replacing photograph which shows SEM (scanning electron microscope) images and the respective images of elements Mn, Si, Mg, S, Al, Fe, O, P and Ca at the same position of the SEM image.

As seen in FIG. 2, Mn, Mg, S and Ca are detected in the same inclusion and the existence of MnS, (Mg, Ca) S and (Mn, Mg, Ca) S is confirmed. Further, as for the form of the inclusion, while a sulfide normally represented by MnS is formed into rod-like form after forging and extending, that in the steel according to this invention is spherical. This is considered to demonstrate that the notch effect by the inclusions is decreased during the mechanical property tests and that impact-resistance anisotropy in mechanical properties is improved.

TABLE 8

| steel type | | (% by weight; Ca, Mg, O: ppm by weight) | | | | | | | | | | | | | |
|---|---|---|---|---|---|---|---|---|---|---|---|---|---|---|---|
| | | C | Si | Mn | P | S | Ni | Cr | Mo | Al | V | Pb | Ca | Mg | O |
| steel of the present invention | X | 0.45 | 0.21 | 0.79 | 0.018 | 0.058 | 0.06 | 0.14 | 0.01 | 0.002 | 0.12 | — | 19 | 9 | 12 |
| conventional steel | Y | 0.44 | 0.24 | 0.82 | 0.017 | 0.051 | 0.05 | 0.22 | 0.01 | 0.033 | 0.08 | 0.11 | 26 | — | 24 |
| | Z | 0.44 | 0.25 | 0.84 | 0.019 | 0.058 | 0.06 | 0.21 | 0.02 | 0.031 | 0.09 | — | — | — | 22 |

Seventh Embodiment

In this embodiment, a steel X according to the present invention and conventional steels Y and Z are prepared and subjected to tests for carbide tool loss by wear, chip disposability indices, deep drilling properties and drill lives. Test conditions and the like are the same as those in the first embodiment. In addition, the distribution of alloy elements on the face worn parts (crater worn parts) of the respective tools is observed.

The conventional steel Y is a lead composite free cutting steel which contains Pb and Ca. The conventional steel Z is a steel which does not contain Pb but in which an Al content is increased, without adding Ca and Mg. A manufacturing method for the steels Y and Z is the same as that of the steel X according to the present invention.

A test result is shown in Table 9.

TABLE 9

| steel type | | carbide tool loss by wear (mm) | chip disposability index | deep drilling property (mm) | drill life (drilling number) |
|---|---|---|---|---|---|
| steel of the present invention | X | 0.07 | 32 | 87 | 922 |
| conventional steel | Y | 0.12 | 32 | 87 | 920 |
| | Z | 0.20 | 3 | 39 | 393 |

As seen in Table 9, the steel X according to the present invention is superior in all of the evaluation items to the conventional steels Y and Z.

Figure 3:
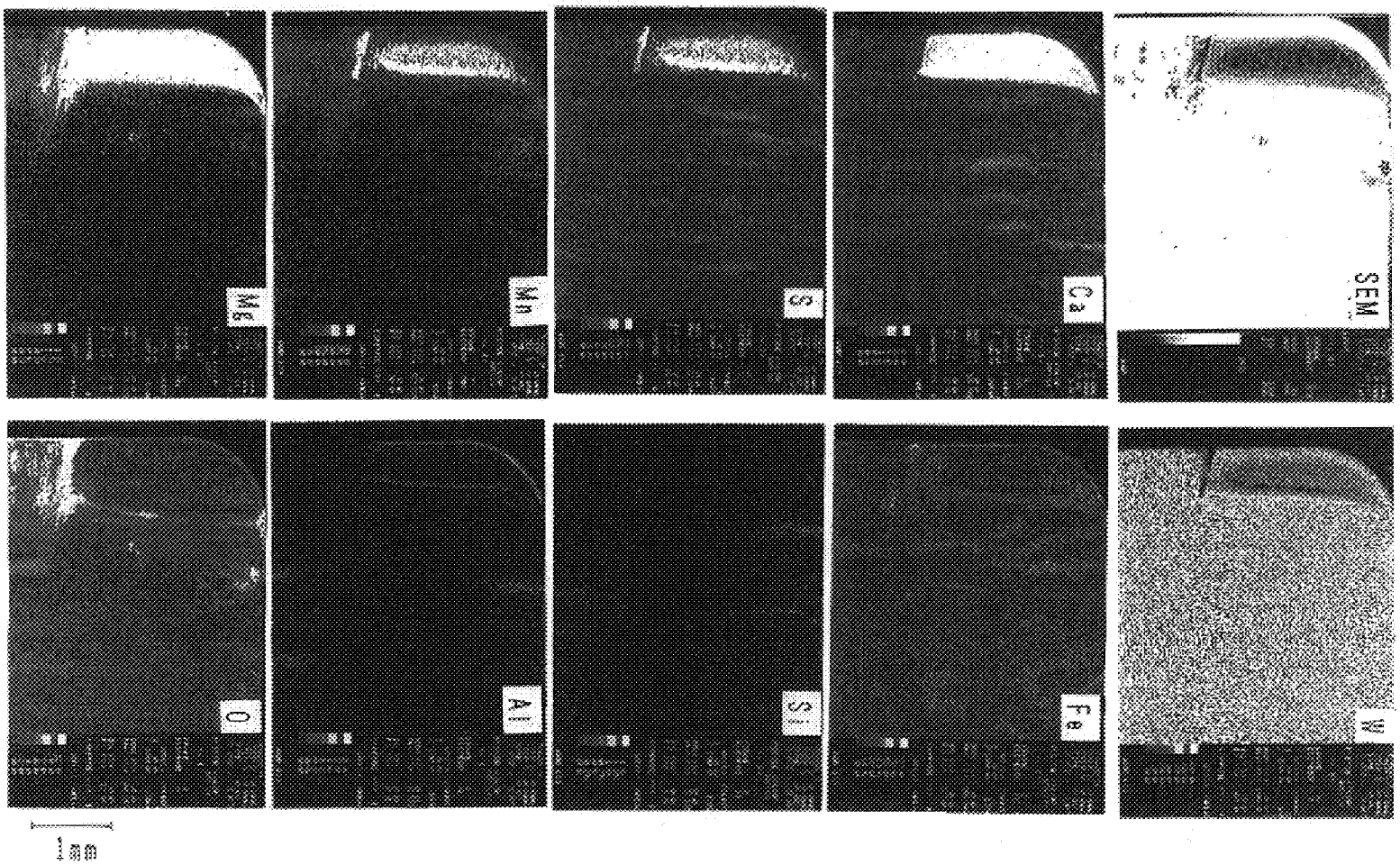
FIG. 3 is a drawing-replacing photograph which shows images of respective elements adhering to a tool employed to cut the steel X according to the present invention in the seventh embodiment.
Figure 4:
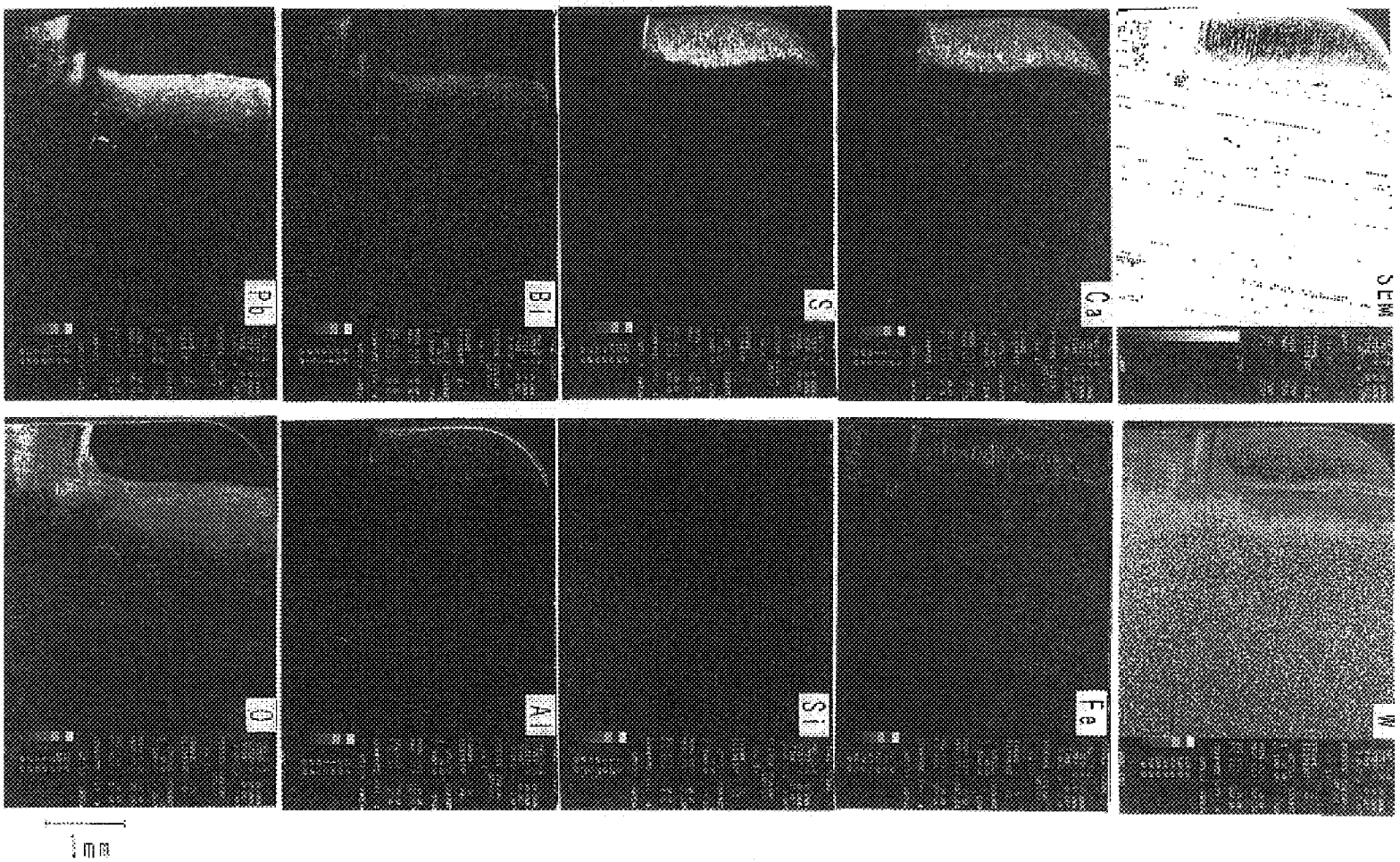
FIG. 4 is a drawing-replacing photograph which shows images of respective elements adhering to a tool employed to cut a conventional steel Y in the seventh embodiment.
Figure 5:
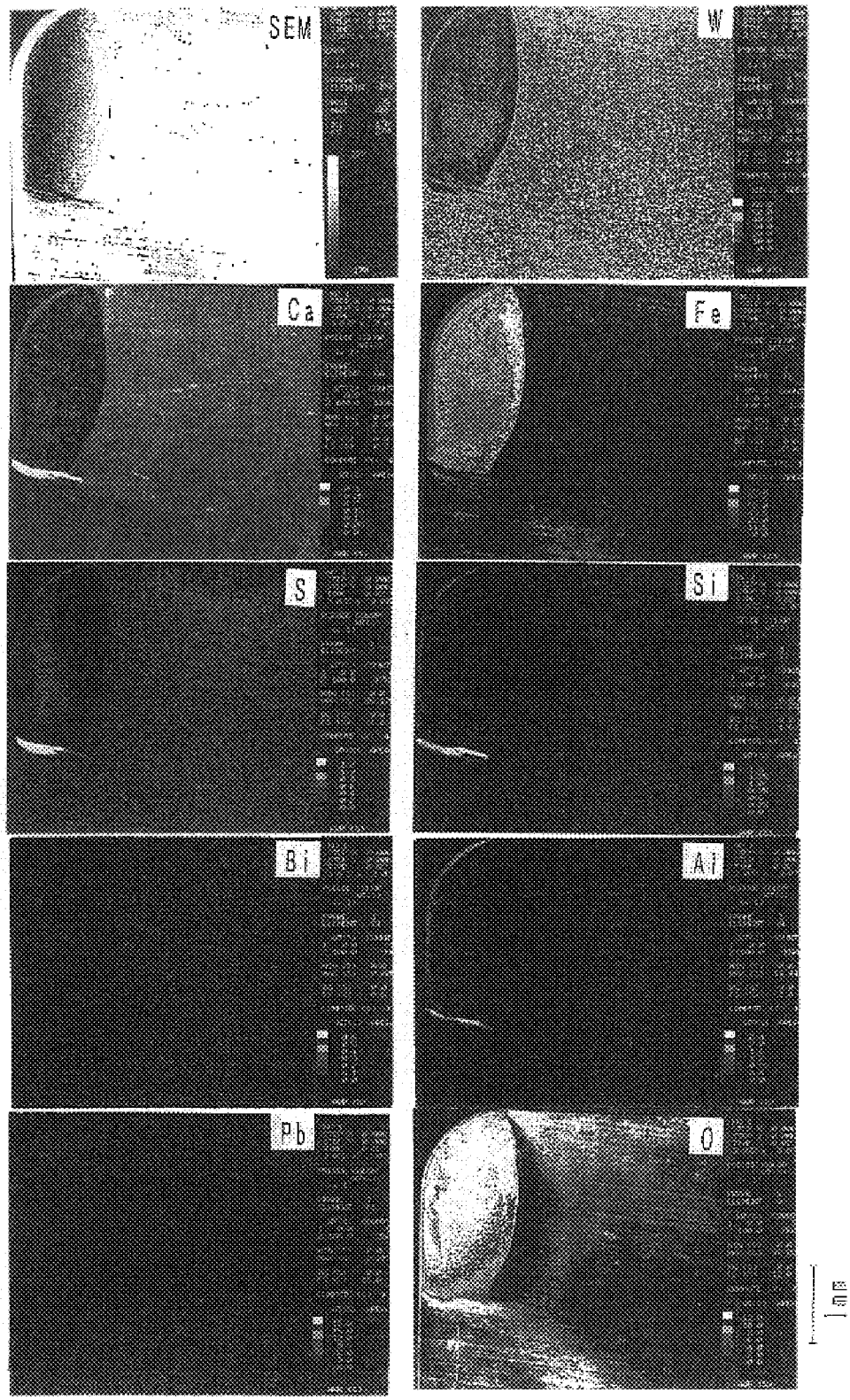
FIG. 5 is a drawing-replacing photograph which shows images of respective elements adhering to a tool employed to cut a conventional steel Z in the seventh embodiment.

Next, the observation results of alloy element distribution are shown in FIGS. 3 to 5. These figures are drawing-replacing photographs each of which shows the SEM image of the surface of the face worn part of the tool after the wear test and the images of elements Ca, S, Mn, Mg, W, Fe, Si, Al and O at the same position of the SEM image.

As seen in FIG. 3, in the steel X according to the present invention, Mn, S, Ca and Mg adhere to the face worn part of the tool. This is considered to demonstrate that the steel exhibits a lubricating function resulting from the composite effect of MnS and (Ca, Mg) S so as to suppress the progress of tool wear.

As seen in FIG. 4, in the conventional steel Y, Ca and S adhere to the worn part and Pb adheres to the end portion of the worn part. Although it can be estimated from this result o that the lubricating function of CaS can suppress the progress of tool wear, the suppression degree is lower than that of the steel X according to the present invention.

As seen in FIG. 5, in the conventional steel Z, S is slightly distributed on the worn part of the tool but Fe and O adhere thereto in large quantities. An Fe oxide is substituted for Co contained in the tool and functions to accelerate the tool wear. It is considered that this is why the tool is largely worn.

Eight Embodiment

In this embodiment, more steels according to the present invention and comparison steels are prepared and evaluated for machinability and the other properties as in the case of the first embodiment.

First, as the steels according to the present invention, 78 types of steels, a1 to a78 obtained by variously changing compositions in composition ranges according to the present invention, respectively, are prepared as shown in Tables 10 to 12.

As the comparison steels, eight types of steels, b1 to b8 which do not fall within respective composition ranges according to the present invention are prepared as shown in Table 13.

The comparison steel b1 has an S content below the lower limit and the comparison steel b2 has an S content exceeding the upper limit. The comparison steel b3 has an Al content exceeding the upper limit. The comparison steel b4 has a Ca content below the lower limit and the comparison steel b5 has a Ca content exceeding the upper limit. The comparison steel b6 has an Mg content below the lower limit and the comparison steel b7 has an Mg content exceeding the upper limit. The comparison steel b8 has an O content exceeding the upper limit.

Heat-treated steels are manufactured in the same manner as that in the first embodiment and non-heat treated steels are manufactured in the same manner as that in the second embodiment. In Tables 14 to 17 to be described later, those that have data in hardening and tempering item are the heat-treated steels and, those that have data in an air-cooling treatment (after heating at 1200° C.) item are the non-heat treated steels.

As to heat-treated steels, mechanical tests are conducted after hardening and tempering; and as to non-heat treated steels, they are conducted after heating at 1200® C. followed by air-cooling treatment. The other conditions are the same as those in the first to third embodiments.

Evaluation results are shown in Tables 14 to 17.

For the clarity of the results, a very good result is indicated by mark ◎, a good result is indicated by mark ○ and a bad result is indicated by mark X.

Judgment criterions for ◎, ○ and X in the respective evaluation items are shown in Table 18.

As seen in Tables 14 to 16, all the steels according to the present invention exhibit superior results in all the evaluation items.

In contrast, as seen in Table 17, none of the comparison steels exhibit satisfactory results in all the evaluation items.

Specifically, the comparison steel b1 the S content of which is below the lower limit cannot attain sufficient properties in carbide tool loss by wear, chip disposability, deep drilling property and drill life.

The comparison steel b2 the S content of which exceeds the upper limit is inferior in impact-resistance anisotropy and endurance ratio.

The comparison steel b3 the Al content of which exceeds the upper limit is inferior in carbide tool loss by wear and endurance ratio. Further, compared to non-heat treated steel (air-cooled steels) among the steels a1 to a78 of the present invention, since the comparison steel b3 consists of the non-heat treated steel, the deep drilling property and drill life of the comparison steel b3 do not reach very good level but remain at good level, whereas almost all the steels according to the present invention exhibit very good levels in deep drilling and drill life like Pb-containing free cutting steels.

The comparison steel b4 the Ca content of which is below the lower limit does not exhibit excellent carbide tool loss by wear, drill life and impact-resistance anisotropy.

The comparison steel b5 the Ca content of which exceeds its upper limit does not exhibit an excellent endurance ratio.

The comparison steel b6 the Mg content of which is below the lower limit does not exhibit excellent carbide tool loss by wear, drill life and impact-resistance anisotropy.

The comparison steel b7 the Mg content of which exceeds the upper limit does not exhibit an excellent endurance ratio.

The comparison steel b8 the O content of which exceeds the upper limit does not exhibit excellent carbide tool loss by wear, drill life and endurance ratio.

TABLE 10

| steel | | Chemical Component (% by weight) | | | | | | | | | | | | | | | | |
|---|---|---|---|---|---|---|---|---|---|---|---|---|---|---|---|---|---|---|
| type | No. | C | Si | Mn | S | Cr | Al | Ca | Mg | O | Mo | Ni | V | Nb | Ti | B | Bi | REM |
| steel | a1 | 0.11 | 0.25 | 0.91 | 0.101 | 0.50 | 0.002 | 0.0012 | 0.0009 | 0.0015 | 0.16 | 0.75 | — | — | — | — | — | — |
| of the | a2 | 0.63 | 0.24 | 0.78 | 0.177 | 0.22 | 0.003 | 0.0015 | 0.0012 | 0.0011 | — | — | — | — | — | — | — | — |
| present | a3 | 0.36 | 0.23 | 0.81 | 0.103 | 1.01 | 0.001 | 0.0015 | 0.0010 | 0.0013 | — | — | — | — | — | — | — | — |
| invention | a4 | 0.46 | 0.26 | 0.85 | 0.101 | 1.07 | 0.002 | 0.0016 | 0.0017 | 0.0013 | — | — | — | — | — | — | — | — |
| | a5 | 0.37 | 0.25 | 1.21 | 0.161 | 0.25 | 0.002 | 0.0018 | 0.0012 | 0.0016 | — | — | 0.12 | — | — | — | — | — |
| | a6 | 0.43 | 0.25 | 1.18 | 0.172 | 0.22 | 0.002 | 0.0015 | 0.0013 | 0.0014 | — | — | 0.10 | — | — | — | — | — |
| | a7 | 0.32 | 0.24 | 0.97 | 0.106 | 1.24 | 0.003 | 0.0014 | 0.0016 | 0.0014 | — | — | — | — | — | — | — | — |
| | a8 | 0.51 | 0.22 | 0.71 | 0.099 | 0.84 | 0.002 | 0.0015 | 0.0014 | 0.0015 | — | — | — | — | — | — | — | — |
| | a9 | 0.32 | 0.26 | 1.48 | 0.165 | 0.23 | 0.003 | 0.0015 | 0.0014 | 0.0012 | — | — | 0.15 | — | — | — | — | — |
| | a10 | 0.48 | 0.27 | 1.00 | 0.164 | 0.23 | 0.002 | 0.0017 | 0.0012 | 0.0011 | — | — | 0.07 | — | — | — | — | — |
| | a11 | 0.41 | 0.05 | 0.96 | 0.171 | 0.25 | 0.002 | 0.0020 | 0.0015 | 0.0016 | — | — | 0.10 | — | — | — | — | — |
| | a12 | 0.40 | 0.93 | 0.65 | 0.168 | 0.20 | 0.002 | 0.0022 | 0.0012 | 0.0014 | — | — | 0.10 | — | — | — | — | — |
| | a13 | 0.39 | 0.15 | 0.80 | 0.100 | 1.03 | 0.002 | 0.0014 | 0.0017 | 0.0011 | — | — | — | — | — | — | — | — |
| | a14 | 0.39 | 0.35 | 0.78 | 0.104 | 1.12 | 0.001 | 0.0021 | 0.0008 | 0.0018 | — | — | — | — | — | — | — | — |
| | a15 | 0.40 | 0.15 | 1.22 | 0.168 | 0.20 | 0.002 | 0.0022 | 0.0012 | 0.0012 | — | — | 0.11 | — | — | — | — | — |
| | a16 | 0.40 | 0.35 | 1.21 | 0.172 | 0.21 | 0.002 | 0.0016 | 0.0018 | 0.0016 | — | — | 0.12 | — | — | — | — | — |
| | a17 | 0.39 | 0.10 | 0.80 | 0.100 | 1.03 | 0.002 | 0.0014 | 0.0017 | 0.0011 | — | — | — | — | — | — | — | — |
| | a18 | 0.39 | 0.45 | 0.78 | 0.104 | 1.12 | 0.001 | 0.0021 | 0.0008 | 0.0018 | — | — | — | — | — | — | — | — |
| | a19 | 0.40 | 0.10 | 1.22 | 0.168 | 0.20 | 0.002 | 0.0022 | 0.0012 | 0.0012 | — | — | 0.11 | — | — | — | — | — |
| | a20 | 0.40 | 0.45 | 1.21 | 0.172 | 0.21 | 0.002 | 0.0016 | 0.0018 | 0.0016 | — | — | 0.12 | — | — | — | — | — |
| | a21 | 0.40 | 0.25 | 0.32 | 0.040 | 1.98 | 0.003 | 0.0020 | 0.0016 | 0.0013 | — | — | — | — | — | — | — | — |
| | a22 | 0.40 | 0.25 | 2.48 | 0.040 | 0.11 | 0.002 | 0.0018 | 0.0015 | 0.0012 | — | — | — | — | — | — | — | — |
| | a23 | 0.41 | 0.24 | 0.60 | 0.101 | 1.19 | 0.002 | 0.0015 | 0.0013 | 0.0016 | — | — | — | — | — | — | — | — |
| | a24 | 0.40 | 0.25 | 0.85 | 0.100 | 0.92 | 0.001 | 0.0018 | 0.0008 | 0.0014 | — | — | — | — | — | — | — | — |
| | a25 | 0.40 | 0.25 | 1.10 | 0.174 | 0.25 | 0.002 | 0.0016 | 0.0012 | 0.0011 | — | — | 0.12 | — | — | — | — | — |
| | a26 | 0.40 | 0.26 | 1.30 | 0.169 | 0.15 | 0.002 | 0.0018 | 0.0010 | 0.0013 | — | — | 0.12 | — | — | — | — | — |
| | a27 | 0.40 | 0.25 | 0.51 | 0.101 | 1.24 | 0.002 | 0.0015 | 0.0013 | 0.0016 | — | — | — | — | — | — | — | — |
| | a28 | 0.40 | 0.23 | 0.99 | 0.100 | 0.82 | 0.001 | 0.0018 | 0.0008 | 0.0014 | — | — | — | — | — | — | — | — |
| | a29 | 0.39 | 0.27 | 0.80 | 0.172 | 0.53 | 0.002 | 0.0015 | 0.0018 | 0.0012 | — | — | 0.12 | — | — | — | — | — |
| | a30 | 0.40 | 0.25 | 1.50 | 0.172 | 0.11 | 0.002 | 0.0015 | 0.0009 | 0.0013 | — | — | 0.12 | — | — | — | — | — |

TABLE 11

| steel | | Chemical Component (% by weight) | | | | | | | | | | | | | | | | |
|---|---|---|---|---|---|---|---|---|---|---|---|---|---|---|---|---|---|---|
| type | No. | C | Si | Mn | S | Cr | Al | Ca | Mg | O | Mo | Ni | V | Nb | Ti | B | Bi | REM |
| steel | a31 | 0.40 | 0.25 | 0.92 | 0.032 | 0.20 | 0.002 | 0.0021 | 0.0014 | 0.0014 | — | — | 0.12 | — | — | — | — | — |
| of the | a32 | 0.41 | 0.24 | 1.37 | 0.347 | 0.19 | 0.003 | 0.0039 | 0.0028 | 0.0016 | — | — | 0.12 | — | — | — | — | — |
| present | a33 | 0.40 | 0.25 | 0.78 | 0.080 | 1.07 | 0.002 | 0.0015 | 0.0011 | 0.0016 | — | — | — | — | — | — | — | — |
| invention | a34 | 0.40 | 0.23 | 0.83 | 0.120 | 1.09 | 0.002 | 0.0019 | 0.0015 | 0.0013 | — | — | — | — | — | — | — | — |
| | a35 | 0.39 | 0.25 | 0.81 | 0.140 | 1.00 | 0.002 | 0.0014 | 0.0017 | 0.0013 | — | — | — | — | — | — | — | — |
| | a36 | 0.40 | 0.25 | 0.85 | 0.180 | 1.03 | 0.003 | 0.0018 | 0.0010 | 0.0015 | — | — | — | — | — | — | — | — |
| | a37 | 0.40 | 0.24 | 1.03 | 0.080 | 0.21 | 0.002 | 0.0025 | 0.0011 | 0.0011 | — | — | 0.12 | — | — | — | — | — |
| | a38 | 0.39 | 0.25 | 1.03 | 0.120 | 0.19 | 0.002 | 0.0023 | 0.0017 | 0.0014 | — | — | 0.12 | — | — | — | — | — |
| | a39 | 0.40 | 0.24 | 1.20 | 0.140 | 0.20 | 0.002 | 0.0021 | 0.0012 | 0.0011 | — | — | 0.11 | — | — | — | — | — |
| | a40 | 0.40 | 0.24 | 1.20 | 0.180 | 0.20 | 0.003 | 0.0020 | 0.0020 | 0.0011 | — | — | 0.12 | — | — | — | — | — |
| | a41 | 0.40 | 0.25 | 2.48 | 0.040 | 0.11 | 0.002 | 0.0018 | 0.0015 | 0.0012 | — | — | — | — | — | — | — | — |
| | a42 | 0.40 | 0.25 | 0.32 | 0.040 | 1.98 | 0.003 | 0.0020 | 0.0016 | 0.0013 | — | — | — | — | — | — | — | — |
| | a43 | 0.40 | 0.25 | 0.85 | 0.100 | 0.92 | 0.001 | 0.0018 | 0.0008 | 0.0014 | — | — | — | — | — | — | — | — |
| | a44 | 0.41 | 0.24 | 0.60 | 0.101 | 1.19 | 0.002 | 0.0015 | 0.0013 | 0.0016 | — | — | — | — | — | — | — | — |
| | a45 | 0.40 | 0.26 | 1.30 | 0.169 | 0.15 | 0.002 | 0.0018 | 0.0010 | 0.0013 | — | — | 0.12 | — | — | — | — | — |
| | a46 | 0.40 | 0.25 | 1.10 | 0.174 | 0.25 | 0.002 | 0.0016 | 0.0012 | 0.0011 | — | — | 0.12 | — | — | — | — | — |
| | a47 | 0.40 | 0.23 | 0.99 | 0.100 | 0.82 | 0.001 | 0.0018 | 0.0008 | 0.0014 | — | — | — | — | — | — | — | — |
| | a48 | 0.40 | 0.25 | 0.51 | 0.101 | 1.24 | 0.002 | 0.0015 | 0.0013 | 0.0016 | — | — | — | — | — | — | — | — |
| | a49 | 0.40 | 0.25 | 1.50 | 0.172 | 0.11 | 0.002 | 0.0015 | 0.0009 | 0.0013 | — | — | 0.12 | — | — | — | — | — |
| | a50 | 0.39 | 0.27 | 0.80 | 0.172 | 0.53 | 0.002 | 0.0015 | 0.0018 | 0.0012 | — | — | 0.12 | — | — | — | — | — |
| | a51 | 0.40 | 0.25 | 1.20 | 0.166 | 0.20 | 0.004 | 0.0024 | 0.0009 | 0.0014 | — | — | 0.12 | — | — | — | — | — |
| | a52 | 0.40 | 0.25 | 1.20 | 0.166 | 0.20 | 0.004 | 0.0024 | 0.0009 | 0.0014 | — | — | 0.12 | — | — | — | — | — |
| | a53 | 0.41 | 0.25 | 1.19 | 0.162 | 0.20 | 0.002 | 0.0005 | 0.0011 | 0.0012 | — | — | 0.12 | — | — | — | — | — |
| | a54 | 0.40 | 0.26 | 1.20 | 0.163 | 0.20 | 0.002 | 0.0068 | 0.0012 | 0.0009 | — | — | 0.12 | — | — | — | — | — |
| | a55 | 0.40 | 0.24 | 0.79 | 0.100 | 1.09 | 0.002 | 0.0005 | 0.0008 | 0.0014 | — | — | — | — | — | — | — | — |

TABLE 11-continued

| steel type | No. | Chemical Component (% by weight) C | Si | Mn | S | Cr | Al | Ca | Mg | O | Mo | Ni | V | Nb | Ti | B | Bi | REM |
|---|---|---|---|---|---|---|---|---|---|---|---|---|---|---|---|---|---|---|
| | a56 | 0.39 | 0.24 | 0.80 | 0.103 | 1.11 | 0.002 | 0.0040 | 0.0009 | 0.0015 | — | — | — | — | — | — | — | — |
| | a57 | 0.41 | 0.25 | 1.19 | 0.162 | 0.20 | 0.002 | 0.0005 | 0.0011 | 0.0012 | — | — | 0.12 | — | — | — | — | — |
| | a58 | 0.40 | 0.25 | 1.21 | 0.167 | 0.19 | 0.002 | 0.0040 | 0.0013 | 0.0010 | — | — | 0.12 | — | — | — | — | — |
| | a59 | 0.40 | 0.25 | 1.20 | 0.165 | 0.20 | 0.002 | 0.0023 | 0.0003 | 0.0014 | — | — | 0.12 | — | — | — | — | — |
| | a60 | 0.40 | 0.27 | 1.21 | 0.172 | 0.20 | 0.002 | 0.0019 | 0.0064 | 0.0009 | — | — | 0.11 | — | — | — | — | — |

TABLE 12

| steel type | No. | Chemical Component (% by weight) C | Si | Mn | S | Cr | Al | Ca | Mg | O | Mo | Ni | V | Nb | Ti | B | Bi | REM |
|---|---|---|---|---|---|---|---|---|---|---|---|---|---|---|---|---|---|---|
| steel of the present invention | a61 | 0.39 | 0.24 | 0.81 | 0.103 | 1.08 | 0.002 | 0.0018 | 0.0005 | 0.0013 | — | — | — | — | — | — | — | — |
| | a62 | 0.40 | 0.25 | 0.79 | 0.100 | 1.05 | 0.002 | 0.0022 | 0.0040 | 0.0011 | — | — | — | — | — | — | — | — |
| | a63 | 0.40 | 0.25 | 1.24 | 0.171 | 0.20 | 0.001 | 0.0016 | 0.0005 | 0.0017 | — | — | 0.12 | — | — | — | — | — |
| | a64 | 0.40 | 0.25 | 1.20 | 0.172 | 0.20 | 0.002 | 0.0015 | 0.0040 | 0.0011 | — | — | 0.12 | — | — | — | — | — |
| | a65 | 0.40 | 0.25 | 1.29 | 0.161 | 0.20 | 0.002 | 0.0014 | 0.0012 | 0.0018 | — | — | 0.12 | — | — | — | — | — |
| | a66 | 0.40 | 0.25 | 1.29 | 0.161 | 0.20 | 0.002 | 0.0014 | 0.0012 | 0.0018 | — | — | 0.12 | — | — | — | — | — |
| | a67 | 0.40 | 0.25 | 1.20 | 0.165 | 0.20 | 0.002 | 0.0022 | 0.0012 | 0.0012 | — | — | 0.12 | — | — | — | 0.02 | — |
| | a68 | 0.40 | 0.25 | 1.21 | 0.164 | 0.20 | 0.001 | 0.0020 | 0.0014 | 0.0015 | — | — | 0.12 | — | — | — | 0.18 | — |
| | a69 | 0.40 | 0.24 | 0.80 | 0.103 | 1.02 | 0.002 | 0.0014 | 0.0014 | 0.0011 | — | — | — | — | — | — | 0.02 | — |
| | a70 | 0.40 | 0.25 | 0.82 | 0.102 | 1.04 | 0.002 | 0.0017 | 0.0010 | 0.0013 | — | — | — | — | — | — | 0.10 | — |
| | a71 | 0.40 | 0.25 | 1.20 | 0.166 | 0.20 | 0.002 | 0.0022 | 0.0012 | 0.0012 | — | — | 0.12 | — | — | — | 0.02 | — |
| | a72 | 0.40 | 0.25 | 1.21 | 0.166 | 0.20 | 0.001 | 0.0020 | 0.0014 | 0.0015 | — | — | 0.12 | — | — | — | 0.10 | — |
| | a73 | 0.41 | 0.26 | 1.20 | 0.166 | 0.20 | 0.002 | 0.0015 | 0.0012 | 0.0012 | — | — | 0.12 | — | — | — | — | 0.002 |
| | a74 | 0.40 | 0.25 | 1.19 | 0.168 | 0.20 | 0.002 | 0.0020 | 0.0012 | 0.0013 | — | — | 0.12 | — | — | — | — | 0.260 |
| | a75 | 0.40 | 0.24 | 0.79 | 0.099 | 1.02 | 0.002 | 0.0014 | 0.0014 | 0.0011 | — | — | — | — | — | — | — | 0.050 |
| | a76 | 0.39 | 0.25 | 0.81 | 0.104 | 1.04 | 0.002 | 0.0017 | 0.0010 | 0.0013 | — | — | — | — | — | — | — | 0.100 |
| | a77 | 0.40 | 0.25 | 1.22 | 0.166 | 0.20 | 0.002 | 0.0013 | 0.0013 | 0.0010 | — | — | 0.12 | — | — | — | — | 0.050 |
| | a78 | 0.40 | 0.25 | 1.21 | 0.168 | 0.20 | 0.002 | 0.0022 | 0.0017 | 0.0014 | — | — | 0.12 | — | — | — | — | 0.150 |

TABLE 13

| steel type | No. | Chemical Component (% by weight) C | Si | Mn | S | Cr | Al | Ca | Mg | O | Mo | Ni | V | Nb | Ti | B | Bi | REM |
|---|---|---|---|---|---|---|---|---|---|---|---|---|---|---|---|---|---|---|
| comparison steel | b1 | 0.40 | 0.25 | 0.82 | 0.020 | 0.20 | 0.002 | 0.0016 | 0.0013 | 0.0015 | — | — | 0.12 | — | — | — | — | — |
| | b2 | 0.40 | 0.26 | 1.38 | 0.370 | 0.20 | 0.002 | 0.0014 | 0.0011 | 0.0016 | — | — | 0.12 | — | — | — | — | — |
| | b3 | 0.41 | 0.25 | 1.20 | 0.171 | 0.20 | 0.012 | 0.0022 | 0.0010 | 0.0016 | — | — | 0.11 | — | — | — | — | — |
| | b4 | 0.41 | 0.25 | 1.22 | 0.161 | 0.20 | 0.002 | 0.0003 | 0.0011 | 0.0012 | — | — | 0.12 | — | — | — | — | — |
| | b5 | 0.40 | 0.24 | 1.20 | 0.165 | 0.19 | 0.002 | 0.0210 | 0.0018 | 0.0009 | — | — | 0.12 | — | — | — | — | — |
| | b6 | 0.40 | 0.25 | 1.19 | 0.162 | 0.20 | 0.002 | 0.0016 | 0.0002 | 0.0016 | — | — | 0.12 | — | — | — | — | — |
| | b7 | 0.40 | 0.25 | 1.20 | 0.162 | 0.21 | 0.002 | 0.0018 | 0.0210 | 0.0014 | — | — | 0.12 | — | — | — | — | — |
| | b8 | 0.41 | 0.26 | 1.23 | 0.162 | 0.20 | 0.002 | 0.0013 | 0.0011 | 0.0022 | — | — | 0.12 | — | — | — | — | — |

TABLE 14

| steel type | No. | carbide tool loss by wear (mm) | E | chip disposability index (index) | E | deep drilling property (mm) | E | drill life (drilling number) | E | air-cooling treatment hardness (Hv) | tensile strength (Mpa) | hardening and tempering hardness (Hv) | tensile strength (Mpa) | impact-resistance anisotropy (T/L) | E | endurance ratio (endurance ratio) | E |
|---|---|---|---|---|---|---|---|---|---|---|---|---|---|---|---|---|---|
| steel of the present invention | a1 | 0.05 | ○ | 21 | ○ | 73 | ◎ | 861 | ◎ | 182 | — | 401 | 1281 | 0.47 | ○ | 0.49 | ○ |
| | a2 | 0.09 | ○ | 29 | ○ | 76 | ◎ | 754 | ○ | — | — | 301 | 972 | 0.36 | ○ | 0.47 | ○ |
| | a3 | 0.11 | ○ | 14 | ○ | 67 | ○ | 650 | ○ | — | — | 282 | 918 | 0.33 | ○ | 0.50 | ○ |
| | a4 | 0.12 | ○ | 13 | ○ | 62 | ○ | 614 | ○ | — | — | 306 | 994 | 0.33 | ○ | 0.49 | ○ |
| | a5 | 0.06 | ○ | 34 | ○ | 94 | ◎ | 1241 | ◎ | 238 | 776 | — | — | 0.36 | ○ | 0.46 | ○ |
| | a6 | 0.08 | ○ | 31 | ○ | 94 | ◎ | 1117 | ◎ | 254 | 820 | — | — | 0.34 | ○ | 0.45 | ○ |
| | a7 | 0.12 | ○ | 14 | ○ | 68 | ○ | 675 | ○ | — | — | 280 | 912 | 0.31 | ○ | 0.51 | ○ |
| | a8 | 0.12 | ○ | 13 | ○ | 64 | ○ | 622 | ○ | — | — | 325 | 1054 | 0.30 | ○ | 0.49 | ○ |
| | a9 | 0.06 | ○ | 32 | ○ | 94 | ◎ | 1212 | ◎ | 245 | 798 | — | — | 0.35 | ○ | 0.47 | ○ |
| | a10 | 0.07 | ○ | 34 | ○ | 94 | ◎ | 1160 | ◎ | 248 | 807 | — | — | 0.33 | ○ | 0.44 | ○ |

TABLE 14-continued

| steel type | No. | carbide tool loss by wear (mm) | E | chip disposability index (index) | E | deep drilling property (mm) | E | drill life (drilling number) | E | air-cooling treatment hardness (Hv) | air-cooling treatment tensile strength (Mpa) | hardening and tempering hardness (Hv) | hardening and tempering tensile strength (Mpa) | impact-resistance anisotropy (T/L) | E | endurance ratio (endurance ratio) | E |
|---|---|---|---|---|---|---|---|---|---|---|---|---|---|---|---|---|---|
| | a11 | 0.08 | ○ | 32 | ○ | 94 | ◎ | 1121 | ◎ | 252 | 818 | — | — | 0.33 | ○ | 0.45 | ○ |
| | a12 | 0.08 | ○ | 31 | ○ | 94 | ◎ | 1106 | ◎ | 257 | 820 | — | — | 0.35 | ○ | 0.45 | ○ |
| | a13 | 0.11 | ○ | 15 | ○ | 68 | ○ | 666 | ○ | — | — | 289 | 935 | 0.32 | ○ | 0.51 | ○ |
| | a14 | 0.11 | ○ | 14 | ○ | 66 | ○ | 648 | ○ | — | — | 292 | 935 | 0.32 | ○ | 0.50 | ○ |
| | a15 | 0.07 | ○ | 32 | ○ | 94 | ◎ | 1128 | ◎ | 249 | 809 | — | — | 0.34 | ○ | 0.46 | ○ |
| | a16 | 0.08 | ○ | 31 | ○ | 94 | ◎ | 1100 | ◎ | 254 | 821 | — | — | 0.34 | ○ | 0.45 | ○ |
| | a17 | 0.11 | ○ | 15 | ○ | 68 | ○ | 666 | ○ | — | — | 289 | 935 | 0.32 | ○ | 0.51 | ○ |
| | a18 | 0.11 | ○ | 14 | ○ | 66 | ○ | 648 | ○ | — | — | 292 | 935 | 0.32 | ○ | 0.50 | ○ |
| | a19 | 0.07 | ○ | 32 | ○ | 94 | ◎ | 1128 | ◎ | 249 | 809 | — | — | 0.34 | ○ | 0.46 | ○ |
| | a20 | 0.08 | ○ | 31 | ○ | 94 | ◎ | 1100 | ◎ | 254 | 821 | — | — | 0.34 | ○ | 0.45 | ○ |
| | a21 | 0.11 | ○ | 13 | ○ | 62 | ○ | 664 | ○ | — | — | 294 | 938 | 0.41 | ○ | 0.49 | ○ |
| | a22 | 0.12 | ○ | 14 | ○ | 61 | ○ | 621 | ○ | — | — | 288 | 934 | 0.40 | ○ | 0.49 | ○ |
| | a23 | 0.11 | ○ | 15 | ○ | 66 | ○ | 668 | ○ | — | — | 290 | 936 | 0.33 | ○ | 0.50 | ○ |
| | a24 | 0.11 | ○ | 14 | ○ | 64 | ○ | 643 | ○ | — | — | 296 | 940 | 0.32 | ○ | 0.51 | ○ |
| | a25 | 0.08 | ○ | 31 | ○ | 94 | ◎ | 1106 | ◎ | 253 | 820 | — | — | 0.34 | ○ | 0.45 | ○ |
| | a26 | 0.08 | ○ | 31 | ○ | 94 | ◎ | 1097 | ◎ | 258 | 823 | — | — | 0.34 | ○ | 0.45 | ○ |
| | a27 | 0.11 | ○ | 15 | ○ | 66 | ○ | 668 | ○ | — | — | 290 | 936 | 0.33 | ○ | 0.50 | ○ |
| | a28 | 0.11 | ○ | 14 | ○ | 64 | ○ | 643 | ○ | — | — | 296 | 940 | 0.32 | ○ | 0.51 | ○ |
| | a29 | 0.08 | ○ | 32 | ○ | 94 | ◎ | 1111 | ◎ | 243 | 790 | — | — | 0.33 | ○ | 0.46 | ○ |
| | a30 | 0.08 | ○ | 31 | ○ | 94 | ◎ | 1102 | ◎ | 251 | 809 | — | — | 0.34 | ○ | 0.45 | ○ |

E: evaluation

TABLE 15

| steel type | No. | carbide tool loss by wear (mm) | E | chip disposability index (index) | E | deep drilling property (mm) | E | drill life (drilling number) | E | air-cooling treatment hardness (Hv) | air-cooling treatment tensile strength (Mpa) | hardening and tempering hardness (Hv) | hardening and tempering tensile strength (Mpa) | impact-resistance anisotropy (T/L) | E | endurance ratio (endurance ratio) | E |
|---|---|---|---|---|---|---|---|---|---|---|---|---|---|---|---|---|---|
| steel of the present invention | a31 | 0.07 | ○ | 32 | ○ | 68 | ○ | 821 | ○ | 245 | 793 | — | — | 0.39 | ○ | 0.45 | ○ |
| | a32 | 0.06 | ○ | 36 | ◎ | 94 | ◎ | 1296 | ◎ | 242 | 792 | — | — | 0.31 | ○ | 0.45 | ○ |
| | a33 | 0.11 | ○ | 14 | ○ | 66 | ○ | 660 | ○ | — | — | 288 | 937 | 0.33 | ○ | 0.51 | ○ |
| | a34 | 0.10 | ○ | 15 | ○ | 68 | ○ | 692 | ○ | — | — | 284 | 932 | 0.32 | ○ | 0.50 | ○ |
| | a35 | 0.10 | ○ | 24 | ○ | 94 | ◎ | 835 | ○ | — | — | 291 | 935 | 0.31 | ○ | 0.51 | ○ |
| | a36 | 0.10 | ○ | 26 | ○ | 94 | ◎ | 898 | ◎ | — | — | 286 | 932 | 0.31 | ○ | 0.50 | ○ |
| | a37 | 0.08 | ○ | 27 | ○ | 94 | ◎ | 1074 | ◎ | 250 | 810 | — | — | 0.35 | ○ | 0.46 | ○ |
| | a38 | 0.08 | ○ | 29 | ○ | 94 | ◎ | 1082 | ◎ | 247 | 808 | — | — | 0.33 | ○ | 0.46 | ○ |
| | a39 | 0.08 | ○ | 31 | ○ | 94 | ◎ | 1124 | ◎ | 251 | 810 | — | — | 0.34 | ○ | 0.46 | ○ |
| | a40 | 0.07 | ○ | 33 | ○ | 94 | ◎ | 1155 | ◎ | 251 | 810 | — | — | 0.33 | ○ | 0.45 | ○ |
| | a41 | 0.12 | ○ | 14 | ○ | 61 | ○ | 621 | ○ | — | — | 288 | 934 | 0.40 | ○ | 0.49 | ○ |
| | a42 | 0.11 | ○ | 13 | ○ | 62 | ○ | 664 | ○ | — | — | 294 | 938 | 0.41 | ○ | 0.49 | ○ |
| | a43 | 0.11 | ○ | 14 | ○ | 64 | ○ | 643 | ○ | — | — | 296 | 940 | 0.32 | ○ | 0.51 | ○ |
| | a44 | 0.11 | ○ | 15 | ○ | 66 | ○ | 668 | ○ | — | — | 290 | 936 | 0.33 | ○ | 0.50 | ○ |
| | a45 | 0.08 | ○ | 31 | ○ | 94 | ◎ | 1097 | ◎ | 258 | 823 | — | — | 0.34 | ○ | 0.45 | ○ |
| | a46 | 0.08 | ○ | 31 | ○ | 94 | ◎ | 1106 | ◎ | 253 | 820 | — | — | 0.34 | ○ | 0.45 | ○ |
| | a47 | 0.11 | ○ | 14 | ○ | 64 | ○ | 643 | ○ | — | — | 296 | 940 | 0.32 | ○ | 0.51 | ○ |
| | a48 | 0.11 | ○ | 15 | ○ | 66 | ○ | 668 | ○ | — | — | 290 | 936 | 0.33 | ○ | 0.50 | ○ |
| | a49 | 0.08 | ○ | 31 | ○ | 94 | ◎ | 1102 | ◎ | 251 | 809 | — | — | 0.34 | ○ | 0.45 | ○ |
| | a50 | 0.08 | ○ | 32 | ○ | 94 | ◎ | 1111 | ◎ | 243 | 790 | — | — | 0.33 | ○ | 0.46 | ○ |
| | a51 | 0.09 | ○ | 32 | ○ | 94 | ◎ | 1072 | ◎ | 251 | 808 | — | — | 0.34 | ○ | 0.44 | ○ |
| | a52 | 0.09 | ○ | 32 | ○ | 94 | ◎ | 1072 | ◎ | 251 | 808 | — | — | 0.34 | ○ | 0.44 | ○ |
| | a53 | 0.08 | ○ | 33 | ○ | 94 | ◎ | 1121 | ◎ | 248 | 811 | — | — | 0.32 | ○ | 0.45 | ○ |
| | a54 | 0.06 | ○ | 32 | ○ | 94 | ◎ | 1157 | ◎ | 253 | 814 | — | — | 0.36 | ○ | 0.45 | ○ |
| | a55 | 0.12 | ○ | 15 | ○ | 65 | ○ | 633 | ○ | — | — | 295 | 932 | 0.31 | ○ | 0.51 | ○ |
| | a56 | 0.10 | ○ | 13 | ○ | 66 | ○ | 649 | ○ | — | — | 293 | 933 | 0.33 | ○ | 0.50 | ○ |
| | a57 | 0.08 | ○ | 33 | ○ | 94 | ◎ | 1121 | ◎ | 248 | 811 | — | — | 0.32 | ○ | 0.45 | ○ |
| | a58 | 0.07 | ○ | 33 | ○ | 94 | ◎ | 1149 | ◎ | 249 | 811 | — | — | 0.35 | ○ | 0.45 | ○ |
| | a59 | 0.08 | ○ | 32 | ○ | 94 | ◎ | 1155 | ◎ | 247 | 808 | — | — | 0.33 | ○ | 0.46 | ○ |
| | a60 | 0.07 | ○ | 33 | ○ | 94 | ◎ | 1196 | ◎ | 251 | 810 | — | — | 0.35 | ○ | 0.45 | ○ |

E: evaluation

TABLE 16

| steel type | No. | carbide tool loss by wear (mm) | E | chip disposability index (index) | E | deep drilling property (mm) | E | drill life (drilling number) | E | air-cooling treatment hardness (Hv) | air-cooling treatment tensile strength (Mpa) | hardening and tempering hardness (Hv) | hardening and tempering tensile strength (Mpa) | impact-resistance anisotropy (T/L) | E | endurance ratio (endurance ratio) | E |
|---|---|---|---|---|---|---|---|---|---|---|---|---|---|---|---|---|---|
| steel of the present invention | a61 | 0.11 | ○ | 15 | ○ | 67 | ○ | 651 | ○ | — | — | 292 | 938 | 0.31 | ○ | 0.51 | ○ |
| | a62 | 0.09 | ○ | 15 | ○ | 69 | ○ | 673 | ○ | — | — | 294 | 937 | 0.33 | ○ | 0.50 | ○ |
| | a63 | 0.09 | ○ | 32 | ○ | 94 | ◎ | 1158 | ◎ | 244 | 802 | — | — | 0.32 | ○ | 0.45 | ○ |
| | a64 | 0.07 | ○ | 33 | ○ | 94 | ◎ | 1188 | ◎ | 253 | 812 | — | — | 0.35 | ○ | 0.45 | ○ |
| | a65 | 0.09 | ○ | 31 | ○ | 94 | ◎ | 1089 | ◎ | 254 | 821 | — | — | 0.34 | ○ | 0.45 | ○ |
| | a66 | 0.09 | ○ | 31 | ○ | 94 | ◎ | 1089 | ◎ | 254 | 821 | — | — | 0.34 | ○ | 0.45 | ○ |
| | a67 | 0.07 | ○ | 37 | ◎ | 94 | ◎ | 1384 | ◎ | 249 | 809 | — | — | 0.34 | ○ | 0.45 | ○ |
| | a68 | 0.07 | ○ | 40 | ◎ | 94 | ◎ | 1453 | ◎ | 251 | 813 | — | — | 0.33 | ○ | 0.45 | ○ |
| | a69 | 0.11 | ○ | 24 | ○ | 68 | ○ | 850 | ◎ | — | — | 289 | 935 | 0.32 | ○ | 0.51 | ○ |
| | a70 | 0.11 | ○ | 26 | ○ | 72 | ○ | 904 | ◎ | — | — | 293 | 940 | 0.31 | ○ | 0.50 | ○ |
| | a71 | 0.07 | ○ | 37 | ◎ | 94 | ◎ | 1384 | ◎ | 249 | 809 | — | — | 0.34 | ○ | 0.45 | ○ |
| | a72 | 0.07 | ○ | 38 | ◎ | 94 | ◎ | 1407 | ◎ | 251 | 813 | — | — | 0.33 | ○ | 0.45 | ○ |
| | a73 | 0.07 | ○ | 32 | ○ | 94 | ◎ | 1329 | ◎ | 250 | 810 | — | — | 0.34 | ○ | 0.45 | ○ |
| | a74 | 0.07 | ○ | 35 | ◎ | 94 | ◎ | 1425 | ◎ | 250 | 810 | — | — | 0.33 | ○ | 0.45 | ○ |
| | a75 | 0.09 | ○ | 23 | ○ | 66 | ○ | 847 | ○ | — | — | 290 | 936 | 0.32 | ○ | 0.50 | ○ |
| | a76 | 0.08 | ○ | 25 | ○ | 69 | ○ | 900 | ◎ | — | — | 291 | 936 | 0.31 | ○ | 0.50 | ○ |
| | a77 | 0.07 | ○ | 33 | ○ | 94 | ◎ | 1333 | ◎ | 248 | 809 | — | — | 0.34 | ○ | 0.45 | ○ |
| | a78 | 0.07 | ○ | 34 | ○ | 94 | ◎ | 1408 | ◎ | 253 | 811 | — | — | 0.33 | ○ | 0.45 | ○ |

E: evaluation

TABLE 17

| steel type | No. | carbide tool loss by wear (mm) | E | chip disposability index (index) | E | deep drilling property (mm) | E | drill life (drilling number) | E | air-cooling treatment hardness (Hv) | air-cooling treatment tensile strength (Mpa) | hardening and tempering hardness (Hv) | hardening and tempering tensile strength (Mpa) | impact-resistance anisotropy (T/L) | E | endurance ratio (endurance ratio) | E |
|---|---|---|---|---|---|---|---|---|---|---|---|---|---|---|---|---|---|
| comparison steel | b1 | 0.15 | X | 8 | X | 25 | X | 343 | X | 245 | 793 | — | — | 0.39 | ○ | 0.45 | ○ |
| | b2 | 0.06 | ○ | 36 | ◎ | 94 | ◎ | 1306 | ◎ | 242 | 792 | — | — | 0.15 | X | 0.40 | X |
| | b3 | 0.14 | X | 30 | ◎ | 71 | ○ | 846 | ○ | 253 | 810 | — | — | 0.34 | ○ | 0.41 | X |
| | b4 | 0.14 | X | 33 | ◎ | 94 | ◎ | 530 | X | 250 | 813 | — | — | 0.26 | X | 0.45 | ○ |
| | b5 | 0.06 | ○ | 32 | ◎ | 94 | ◎ | 1159 | ◎ | 256 | 811 | — | — | 0.36 | ○ | 0.41 | X |
| | b6 | 0.14 | X | 32 | ◎ | 94 | ◎ | 538 | X | 247 | 802 | — | — | 0.25 | X | 0.45 | ○ |
| | b7 | 0.07 | ○ | 33 | ◎ | 94 | ◎ | 1162 | ◎ | 246 | 799 | — | — | 0.36 | ○ | 0.40 | X |
| | b8 | 0.13 | X | 30 | ◎ | 87 | ◎ | 544 | X | 249 | 804 | — | — | 0.34 | ○ | 0.41 | X |

E: evaluation

TABLE 18

| | evaluation criterion | | | | | |
|---|---|---|---|---|---|---|
| | carbide tool loss by wear | chip disposability index | deep drilling property | drill life | impact-resistance anisotropy | endurance ratio |
| ◎ | 0.04 or less | 35 or more | 73 or more | 850 or more | 0.50 or more | 0.54 or more |
| ○ | 0.05-0.12 | 13-34 | 61-72 | 600-849 | 0.30-0.49 | 0.43-0.53 |
| X | 0.13 or more | 12 or less | 60 or less | 599 or less | 0.29 or less | 0.42 or less |

As described so far, according to the present invention, it is possible to provide a lead-free steel for machine structural use which does not contain Pb and is equal to or higher than the conventional Pb-containing free cutting steels in properties, excellent in machinability and low in strength anisotropy.

What is claimed is:

1. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis, C: 0.10 to 0.65%;
Si: 0.03 to 1.00%;
Mn: 0.30 to 2.50%;
S: 0.03 to 0.35%;
Al: less than 0.010%;
Ca: 0.0005 to 0.020%;
Mg: 0.0003 to 0.020%;
O: less than 20 ppm; and
the balance being Fe and inevitable impurities.

2. The lead-free steel according to claim 1, wherein Al: less than 0.005%.

3. The lead-free steel according to claim 2, wherein S: 0.04 to 0.30%.

4. The lead-free steel according to claim 1, wherein S: 0.04 to 0.30%.

5. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis,
C: 0.10 to 0.65%;
Si: 0.03 to 1.00%;
Mn: 0.30 to 2.50%;
S: 0.03 to 0.35%;
Al: less than 0.010%;
Ca: 0.0005 to 0.020%;
Mg: 0.0003 to 0.020%;
O: less than 20 ppm;
at least one element selected from the group consisting of, on a weight basis, Mo: 0.05 to 1.00%, Ni: 0.1 to 3.5%, V: 0.01 to 0.50%, Nb: 0.01 to 0.10%, Ti: 0.01 to 0.10% and B: 0.0005 to 0.0100%; and
the balance being Fe and inevitable impurities.

6. The lead-free steel according to claim 5, wherein S: 0.04 to 0.30%.

7. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis,
C: 0.10 to 0.65%;
Si: 0.03 to 1.00%;
Mn: 0.30 to 2.50%;
S: 0.03 to 0.35%;
Al: less than 0.005%;
Ca: 0.0005 to 0.020%;
Mg: 0.0003 to 0.020%;
O: less than 20 ppm;
at least one element selected from the group consisting of, on a weight basis, Mo: 0.05 to 1.00%, Ni: 0.1 to 3.5%, V: 0.01 to 0.50%, Nb: 0.01 to 0.10%, Ti: 0.01 to 0.10% and B: 0.0005 to 0.0100%; and
the balance being Fe and inevitable impurities.

8. The lead-free steel according to claim 7, wherein S: 0.04 to 0.30%.

9. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis,
C: 0.10 to 0.65%;
Si: 0.03 to 1.00%;
Mn: 0.30 to 2.50%;
S: 0.03 to 0.35%;
Al: less than 0.010%;
Ca: 0.0005 to 0.020%;
Mg: 0.0003 to 0.020%;
O: less than 20 ppm;
at least one element selected from the group consisting of, on a weight basis, Bi: 0.01 to 0.30% and REM: 0.001 to 0.10%; and
the balance being Fe and inevitable impurities.

10. The lead-free steel according to claim 9, wherein S: 0.04 to 0.30%.

11. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis,
C: 0.10 to 0.65%;
Si: 0.03 to 1.00%;
Mn: 0.30 to 2.50%;
S: 0.03 to 0.35%;
Al: less than 0.005%;
Ca: 0.0005 to 0.020%;
Mg: 0.0003 to 0.020%;
O: less than 20 ppm;
at least one element selected from the group consisting of, on a weight basis, Bi: 0.01 to 0.30% and REM: 0.001 to 0.10%; and
the balance being Fe and inevitable impurities.

12. The lead-free steel according to claim 11, wherein S: 0.04 to 0.30%.

13. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis,
C: 0.10 to 0.65%;
Si: 0.03 to 1.00%;
Mn: 0.30 to 2.50%;
S: 0.03 to 0.35%;
Al: less than 0.010%;
Ca: 0.0005 to 0.020%;
Mg: 0.0003 to 0.020%;
O: less than 20 ppm;
at least one element selected from the group consisting of, on a weight basis, Mo: 0.05 to 1.00%, Ni: 0.1 to 3.5%, V: 0.01 to 0.50%, Nb: 0.01 to 0.10%, Ti: 0.01 to 0.10% and B: 0.0005 to 0.0100%; and
at least one element selected from the group consisting of, on a weight basis, Bi: 0.01 to 0.30% and REM: 0.001 to 0.10%; and
the balance being Fe and inevitable impurities.

14. The lead-free steel according to claim 13, wherein S: 0.04 to 0.30%.

15. A lead-free steel for machine structural use with excellent machinability and low strength anisotropy, comprising at least one selected from the group consisting of (Ca, Mg)S and (Ca, Mg, Mn)S as a sulfide-based inclusion, consisting of: on a weight basis, C: 0.10 to 0.65%;

Si: 0.03 to 1.00%;

Mn: 0.30 to 2.50%;

S: 0.03 to 0.35%;

Al: less than 0.005%;

Ca: 0.0005 to 0.020%;

Mg: 0.0003 to 0.020%;

O: less than 20 ppm;

at least one element selected from the group consisting of, on a weight basis, Mo: 0.05 to 1.00%, Ni: 0.1 to 3.5%, V: 0.01 to 0.50%, Nb: 0.01 to 0.10%, Ti: 0.01 to 0.10% and B: 0.0005 to 0.0100%; and at least one element selected from the group consisting of, on a weight basis, Bi: 0.01 to 0.30% and REM: 0.001 to 0.10%; and the balance being Fe and inevitable impurities.

16. The lead-free steel according to claim 15, wherein S: 0.04 to 0.30%.

* * * * *